US011269281B2

(12) United States Patent
Higaki

(10) Patent No.: US 11,269,281 B2
(45) Date of Patent: Mar. 8, 2022

(54) IMAGE CARRIER, IMAGE CARRIER UNIT, AND IMAGE FORMATION APPARATUS

(71) Applicant: Oki Data Corporation, Tokyo (JP)

(72) Inventor: Toshimasa Higaki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/195,175

(22) Filed: Mar. 8, 2021

(65) Prior Publication Data

US 2021/0286309 A1 Sep. 16, 2021

(30) Foreign Application Priority Data

Mar. 13, 2020 (JP) ..... JP2020-043991

(51) Int. Cl.
*G03G 15/00* (2006.01)
*G03G 21/16* (2006.01)

(52) U.S. Cl.
CPC ..... *G03G 15/751* (2013.01); *G03G 21/1671* (2013.01)

(58) Field of Classification Search
CPC ... G03G 15/75; G03G 15/751; G03G 21/1671
See application file for complete search history.

(56) References Cited

U.S. PATENT DOCUMENTS 5,960,236 A * 9/1999 Zaman ..... G03G 15/751 399/91
2004/0042822 A1* 3/2004 Fujishiro ..... G03G 15/751 399/159
2006/0099010 A1* 5/2006 Miner ..... G03G 15/751 399/159

FOREIGN PATENT DOCUMENTS

JP 2007-298907 A 11/2007

* cited by examiner

*Primary Examiner* — Sophia S Chen
(74) *Attorney, Agent, or Firm* — Metrolex IP Law Group, PLLC

(57) ABSTRACT

An image carrier according to one or more embodiments may include: a cylindrical image carrier member including an outer circumferential surface formed with an image carrier layer configured to carry a developer image; one or more silencers disposed in the image carrier member; and a bonding member that bonds the one or more the silencers to an inner circumferential surface of the image carrier member. For each silencer, the inner circumferential surface of the image carrier member includes one or more bonding areas to which the bonding member is attached. A bonding range, in which the one or more bonding areas are fit, for each silencer, has a length thereof in an axial direction of the silencer being greater than a length thereof in a circumferential direction of the silencer.

18 Claims, 15 Drawing Sheets

COMPARATIVE EXAMPLE

IMAGE CARRIER, IMAGE CARRIER UNIT, AND IMAGE FORMATION APPARATUS

CROSS REFERENCE TO RELATED APPLICATIONS

This application claims priority based on 35 USC 119 from prior Japanese Patent Application No. 2020-043991 filed on Mar. 13, 2020, entitled "IMAGE CARRIER, IMAGE CARRIER UNIT, AND IMAGE FORMATION APPARATUS", the entire contents of which are incorporated herein by reference.

BACKGROUND

The disclosure may relate to an image carrier, an image carrier unit, and an image formation apparatus.

As a photosensitive drum provided in an image formation apparatus, there is a photosensitive drum in which a cylindrical member called a silencer is inserted into a bare tube of the photosensitive drum (Patent Document 1). The silencer provides an effect of reducing noise generated by the photosensitive drum during printing operations.

Patent Document 1: Japanese Patent Application Publication No. 2007-298907

SUMMARY

An object of an embodiment of the disclosure may be to suppress deterioration of image quality.

A first aspect of an embodiment of the disclosure may be an image carrier that may include: a cylindrical image carrier member including an outer circumferential surface formed with an image carrier layer configured to carry a developer image; one or more silencers disposed in the image carrier member; and a bonding member that bonds the one or more silencers to an inner circumferential surface of the image carrier member. For each silencer, the inner circumferential surface of the image carrier member includes one or more bonding areas to which the bonding member are attached. A bonding range, in which the one or more bonding areas are fitted, for each silencer, includes a length thereof in an axial direction of the silencer greater than a length of thereof in a circumferential direction of the silencer.

A second aspect of an embodiment of the disclosure may be an image carrier unit that may include the image carrier according to the first aspect.

A third aspect of an embodiment of the disclosure may be an image formation apparatus that may include an image carrier unit according to the second aspect.

According to at least one of the aspects described above, it may be possible to suppress deformation of the surface of the image carrier member caused by a difference in the thermal expansion coefficient between the image carrier member and the silencer. This can prevent defects such as uneven density in a printed image.

BRIEF DESCRIPTION OF DRAWINGS

FIGS. 3A and 3B are schematic diagrams illustrating a configuration of the image carrier, wherein FIG. 3A illustrates a schematic view of the image carrier and FIG. 3B illustrates cross-sectional views of the image carrier along the longitudinal direction and the transvers direction.

FIGS. 6A and 6B are explanatory diagrams illustrating views for explaining methods of defining an angle of the range where the bonding area exists in a circumferential direction about an axis of the image carrier, wherein FIG. 6A illustrates a method using a length of an arc between both ends of the bonding area, and FIG. 6B illustrates a method using a length of a line that connects both ends of the bonding area.

FIGS. 7A and 7B are diagrams illustrating views of a configuration of an image carrier according to a second embodiment, wherein FIG. 7A illustrates a schematic view of the image carrier and FIG. 7B illustrates cross-sectional views of the image carrier taken along the vertical direction and the transverse direction thereof.

FIGS. 8A and 8B are schematic diagrams illustrating the bonding region formed by the bonding process in the image carrier, wherein FIG. 8A illustrates a state after assembly in which the silencer is accommodated in the image carrier, and FIG. 8B is a development view of the image carrier member illustrating a state where the image carrier member is unfolded into a plane from a cutting line extending along the axial direction thereof.

FIGS. 9A to 9C are schematic diagrams illustrating a bonding area formed by a bonding process for an image carrier according to a variation example of a second embodiment, wherein FIG. 9A illustrates a relationship of an image carrier member, silencers, and an adhesive before insertion of the silencers, FIG. 9B illustrates a state after assembly in which the two silencers are accommodated in the image carrier member, and FIG. 9C is a development view of the image carrier member illustrating a state where the image carrier member is unfolded into a plane from a cutting line extending along the axial direction thereof.

DETAILED DESCRIPTION

Figure 1:
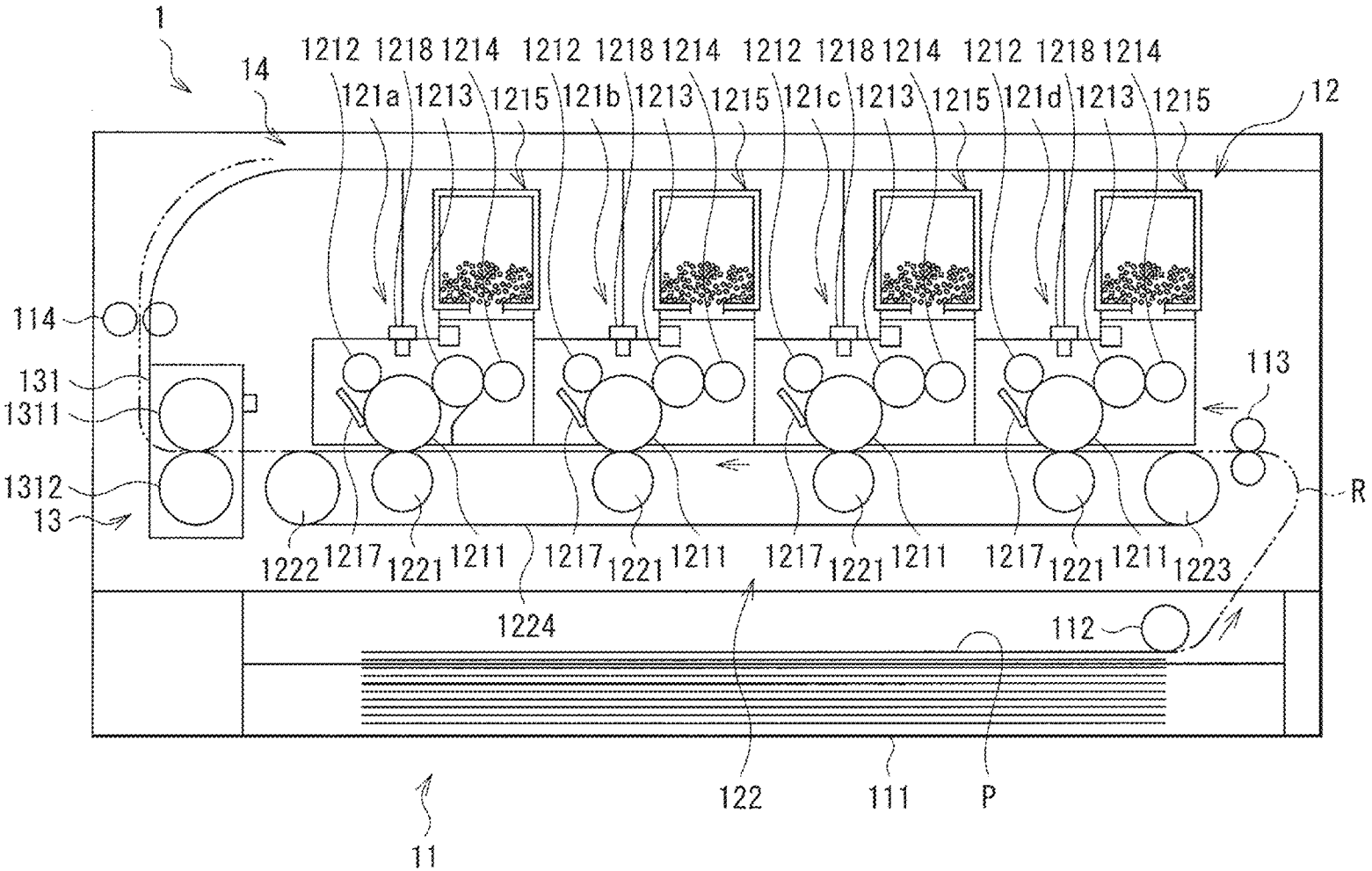
FIG. 1 is a diagram illustrating a schematic view of an internal configuration of an image formation apparatus according to an embodiment.

Descriptions are provided hereinbelow for one or more embodiments based on the drawings. In the respective drawings referenced herein, the same constituents are designated by the same reference numerals and duplicate explanation concerning the same constituents is omitted. All of the drawings are provided to illustrate the respective examples only.

[1. Configuration of Image Formation Apparatus]

FIG. 1 is a diagram illustrating a view of an internal configuration of a printing apparatus 1 serving as an image formation apparatus according to a first embodiment. The printing apparatus 1 according a first embodiment is not limited to a specific type, but may be any type, such as an electrophotographic printer, copier, multifunctional peripheral (MFP), or facsimile machine, which is equipped with a cylindrical image carrier. Furthermore, although a first embodiment describes a case in which a color image is formed by the printing apparatus 1, the printing apparatus 1 can also form a monochromatic image by making changes to a configuration of an image formation section 12 (specifically, image formation units 121).

The printing apparatus 1 can be roughly compartmentalized into a media storage section 11, an image formation section 12, an image fixation section 13, and a discharged paper stack section 14. In a first embodiment, paper (hereinafter may be referred to as "recording paper") P is employed as a recording medium on which an image is to be formed by the printing apparatus 1. The recording paper P travels from the media storage section 11 through the sections described above along a paper conveyance path R (schematically illustrated by the double-dotted chain line). In addition to the recording paper P, a film or the like can be employed as a recording medium.

The media storage section 11 includes a paper cassette 111 in which the recording paper P serving as the recording medium is stored. A first embodiment employs the paper cassette 111 that is removably installed at a lower portion or a bottom portion of the printing apparatus 1. However, the disclosure is not limited thereto. Instead of the paper cassette 111, a tray may be employed, which may be disposed at a front, rear, left, or right side of the printing apparatus 1 and be attached to the printing apparatus 1 in an openable and closeable manner.

Based on a printing instruction from a user or the like, the recording paper P is fed from the paper cassette 111 to the paper conveyance path while being separated one by one. The media storage section 11 includes a paper feed roller (may be referred to as a pickup roller) 112. The paper feed roller 112 feeds a sheet of the recording paper P stacked in the paper cassette 111 into the paper conveyance path R one by one.

The recording paper P fed from the paper cassette 111 passes between a resist roller and a pressure roller (both not illustrated) which correct the skew (i.e., inclination or distortion) of the recording paper P, and is fed by a conveyance roller pair 113 to the image formation section 12 in accordance with the timing of development.

The image formation section 12 is provided with image formation units 121 (121*a* to 121*d*) and a transfer unit 122. Note that each of the image formation units 121*a* to 121*d* may be simply referred to as an image formation unit 121 for convenience. Each image formation unit 121 is detachable from a main body of the printing apparatus 1 (or a housing of the printing apparatus 1).

In a first embodiment, the image formation unit 121 comprises a plurality of monochromatic image formation units 121*a* to 121*d* of primary colors. The image formation unit 121*a* develops a first color (e.g., cyan), the image formation unit 121*b* develops a second color (e.g., magenta), the image formation unit 121*c* develops a third color (e.g., yellow), and the image formation unit 121*d* develops a fourth color (e.g., black). The image formation units 121*a* to 121*d* of the first to fourth colors have the same configuration except for the difference in the color to be developed. In the following description, the configuration of the cyan image formation unit 121*a* (denoted simply by 121 for convenience) is explained in detail as a representative.

A developer (hereinafter may be referred to as "toner") of each color contains a predetermined colorant, a release agent, a charge control agent, a processing agent, and the like, and is made by mixing and/or surface-treating these components as appropriate. The colorant, the release agent, and the charge control agent function as internal additives. The toner can contain silica, titanium dioxide, or the like, as an external additive. As the colorant, a dye or pigment may be used alone, or plural types of dyes and/or pigment may be used in a mixture. Furthermore, as a binding resin or a binder resin, a polyester resin may be employed, for example. With respect to the size of the toner in an embodiment, the average particle diameter of the toner particles is, for example, about 7 μm, and the circularity of the toner particles is, for example, about 0.94-0.98. The average particle size of the external additives is, for example, about 50 to 200 μm.

(Configuration of Image Formation Unit)

Figure 2:
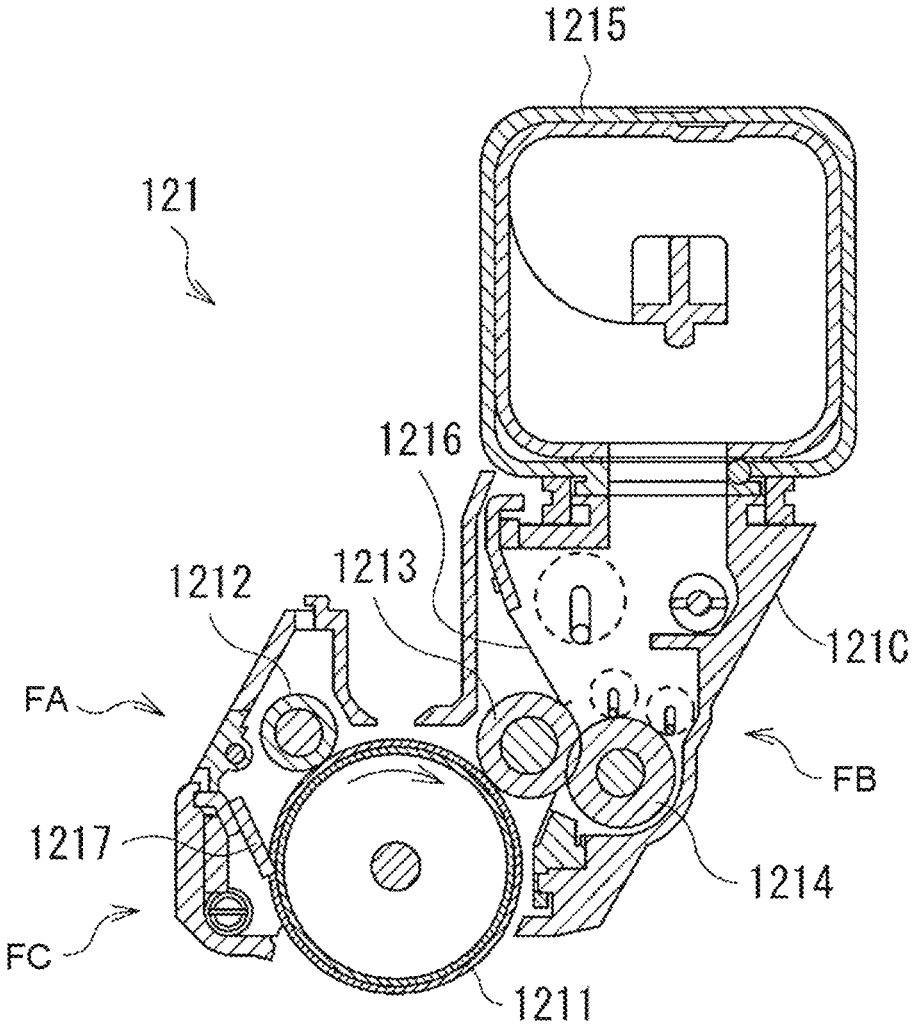
FIG. 2 is a diagram illustrating a cross-sectional view of a configuration of an image formation unit provided in the image formation apparatus, wherein the image formation unit is provided with an image carrier according to a first embodiment.

FIG. 2 is a diagram illustrating a cross-sectional view of a configuration of the image formation unit 121 provided in the printing apparatus 1. The image formation unit 121 includes a photosensitive drum 1211 serving as an image carrier and an image formation unit case 121C serving as an image carrier container that accommodates therein the photosensitive drum 1211. The photosensitive drum 1211 as the image carrier includes a photosensitive drum member 1211*a* as an image carrier member, and a silencer 1211*b* as an insertion member inserted in the photosensitive drum member 1211*a*. The photosensitive drum member 1211*a* may be referred to as an image carrier layer formation member. The photosensitive drum member 1211*a* includes a photoconductive layer as an image carrier layer formed on an outer circumference of a cylindrical bare tube. The silencer 1211*b* makes it possible to reduce the noise generated by the photosensitive drum 1211 during operation of the printing apparatus 1.

The image formation unit 121 includes an image formation unit main body (e.g., an image formation unit cartridge)

and a toner container 1215 that is detachably attached to the image formation unit main body. The image formation unit main body includes the image formation unit case 121*C*. Provided in the image formation unit case 121*C* are the photosensitive drum 1211, a charging roller 1212, a development roller 1213, a supply roller 1214, and a cleaning blade 1217. The image formation unit case 121*C* may be referred to as a photosensitive drum container that houses therein the photosensitive drum 1211. The image formation unit 121 includes a charging section FA, a developing section FB and a cleaning section FC.

The photosensitive drum 1211 includes a cylindrical conductive support (may be referred to as a base or a bare tube, hereinafter referred to as a "bare tube") and a photoconductive layer (may referred to as a photosensitive layer) as an image carrier layer formed on an outer circumference of the bare tube. The photoconductive layer may be formed, for example, by an immersion coating method. The photosensitive drum 1211 is configured such that the silencer 1211*b* is inserted into the photosensitive drum member 1211*a* with the photoconductive layer on the outer circumference of the photosensitive drum member 1211*a*. As will be described later, in a first embodiment, the photosensitive drum member 1211*a* and the silencer 1211*b* are joined by an adhesive as a bonding member. The photosensitive drum member 1211*a* corresponds to an example of an "image carrier member" in an embodiment, and the silencer 1211*b* corresponds to an example of an "insertion member" in an embodiment.

An intermediate layer, called a blocking layer or a UCL layer, may be formed between the bare tube and the photoconductive layer of the photosensitive drum 1211. In such a case, the photosensitive drum member that is composed of the bare tube, the blocking layer and the photoconductive layer corresponds to an "image carrier member."

The bare tube can be fabricated from metal such as aluminum, aluminum alloys, stainless steel, or the like. In a first embodiment, the bare tube is made of aluminum alloy.

The photoconductive layer has a layered structure including a charge generating layer and a charge transport layer. The photosensitive drum member 1211*a* is capable of forming an electrostatic latent image on the outer circumferential surface, by receiving light irradiated from an exposure device 1218 in accordance with image information.

The charge generation layer contains a charge generating substance and a binder resin as main components. As the charge generating substance, it is possible to use organic dyes and pigments. As applicable dyes or pigments, metal-free phthalocyanine, indium copper chloride, gallium chloride, metals such as tin, titanium, zinc, vanadium or oxides thereof, chloride-coordinated phthalocyanines, or azo pigments such as monoazo, hisazo, trisazo, or polyazo can be exemplified. The charge generating layer uses a dispersion layer in which fine particles of the charge generating substance are bound with the binder resin, such as a polyester resin, polyvinyl acetate, polyacrylic ester, polymethacrylic ester, polyester, polycarbonate, polyvinyl acetoacetal, polyvinyl propional, polyvinyl butyral, phenoxy resin, epoxy resin, urethane resin, cellulose ester, cellulose ether, or the like.

The charge transport layer contains a charge transport substance and a binder resin as main components. As the charge transport substance, it is possible to use heterocyclic compounds such as carbazole, indole, imidazole, oxazole, pyrazole, oxadiazole, pyrazoline, thiadiazole or the like, aniline derivatives, hydrazone compounds, aromatic amine derivatives, stilbene derivatives, polymers comprising one or more of these compounds in the main chain or side chain, or other electron donating substances. Examples of the binder resin applicable to the charge transport layer include polycarbonate, polymethyl methacrylate, polystyrene, vinyl polymer such as polyvinyl chloride, polyester, polyester carbonate, polysulfine, polyimide, phenoxy, epoxy, silicone resin, or polymers thereof or partially crosslinked cured products thereof. Polycarbonate is particularly suitable among the above examples. In addition to the above, the charge transport layer may include additives such as antioxidants or sensitizers as necessary.

The charging section FA includes the charging roller 1212. The charging roller 1212 are disposed with an outer circumferential surface thereof in contact with the outer circumferential surface of the photosensitive drum 1211, and configured to rotate along with the rotation of the photosensitive drum 1211. In a first embodiment, as a method for charging the photosensitive drum 1211, a so-called contact charging method is adopted, in which the charging roller 1212 is in contact with the outer circumferential surface of the photosensitive drum 1211 with a DC current being applied to the charging roller 1212.

The developing section FB includes the development roller 1213 and the supply roller 1214. The development roller 1213 is disposed with an outer circumferential surface thereof in contact with the outer circumferential surface of the photosensitive drum 1211. The development roller 1213 develops the electrostatic latent image formed on the photosensitive drum 1211 with the toner as the developer. The supply roller 1214 is provided between the toner container 1215 and the development roller 1213 with the outer circumferential surface of the supply roller 1214 being in contact with the outer circumferential surface of the development roller 1213. The supply roller 1214 receives a supply of the toner from the toner container 1215, and attaches the supplied toner to the outer circumferential surface of the development roller 1213. The rotation direction of the photosensitive drum 1211 and the rotation direction of the development roller 1213 are opposite to each other (e.g., the photosensitive drum 1211 rotates clockwise and the development roller 1213 rotates counterclockwise), and the rotation direction of the development roller 1213 and the rotation direction of the supply roller 1214 are the same as each other (e.g., the development roller 1213 and the supply roller 1214 both rotate counterclockwise). The developing section B further includes a regulation blade 1216 for thinly leveling the toner adhered to the outer circumferential surface of the development roller 1213. The development roller 1213 corresponds to an example of a "supply member" in an embodiment.

The cleaning section FC has a configuration to remove the toner remaining on the photosensitive drum 1211 after transferring to the recording paper P (hereinafter may be referred to as "waste toner") from the photosensitive drum 1211 and collecting the waste toner removed. Specifically, the cleaning section C includes the cleaning blade 1217 whose distal end is in contact with the outer circumferential surface of the photosensitive drum 1211 and whose base end is supported by the housing of the image formation unit 121. The cleaning blade 1217 is configured to scrape the waste toner from the outer circumferential surface of the photosensitive drum 1211. The removed waste toner can be discharged from the image formation unit 121 via a waste toner discharge path.

Returning to FIG. 1, the transfer unit 122 includes transfer rollers 1221 disposed opposite to the image formation units 121, and transfers developer images formed by the image formation units 121 to the recording paper P in a transfer area defined with respect to the recording paper P.

In addition to the transfer roller 1221, the transfer unit 122 includes a pair of guiding rollers (a drive roller 1222 and a driven roller 1223), and an endless transfer belt 1224 which is wound around the pair of guiding rollers 1222 and 1223 in a tensioned state therebetween. Here, an area where the photosensitive drum 1211 of the image formation unit 121 and the transfer belt 1224 of the transfer unit 122 face each other is the transfer area. Upon transferring, the transfer belt 1224 and the recording paper P thereon are sandwiched between the photosensitive drum 1211 and the transfer roller 1221.

As the recording paper P is conveyed toward the image formation section 12, the image formation unit 121 charges the outer circumferential surface of the photosensitive drum 1211 with the charging roller 1212. After the photosensitive drum 1211 is charged, light is irradiated from the exposure device 1218 onto the outer circumferential surface of the photosensitive drum 1211, so as to form an electrostatic latent image corresponding to the image information on the outer circumferential surface of the photosensitive drum 1211. The electrostatic latent image is then developed by the developer to form a developer image (may be referred to as a toner image). As a light source applicable to the exposure device 1218 according to an embodiment, light-emitting diodes (LED) or a laser device can be used for example. The developer image formed on the photosensitive drum 1211 is transferred to the recording paper P being conveyed on the transfer belt 1224. After transferring, the developer remaining on the photosensitive drum 1211 is removed by the cleaning blade 1217, and the photosensitive drum 1211 is then used for a next development and transfer. The above-described process is performed for each of the colors of cyan, magenta, yellow and black. Thus, the transfer of all the developers necessary for forming the desired image is completed in the image formation section 12. The recording paper P is then conveyed from the transfer unit 122 to the image fixation section 13.

The image fixation section 13 includes a fixation unit 131 (or a fixation device) and is configured to fix the developer image transferred to the recording paper P by a high-temperature and high-pressure fixation process. The fixation unit 131 includes a heat roller 1311 and a pressure roller 1312 opposed to each other across the conveyance path R for the recording paper P. The heat roller 1311 incorporates therein a heater for heating. The pressure roller 1312 forms a nip with the heat roller 1311 therebetween, and thus presses the recording paper P against the heat roller 1311 during the fixation process.

The recorded paper P on which the desired image is fixed is further conveyed by the discharge roller pair 114 and thus discharged through a discharge port (not illustrated) to the discharged paper stack section 14 (or a discharged paper stacker) formed in an upper cover of the printing apparatus housing. The discharged paper stack section 14 is a place where the recording paper P on which the desired image is printed is to be temporarily stacked.

(Configuration of Image Carrier)

Figure 3A:
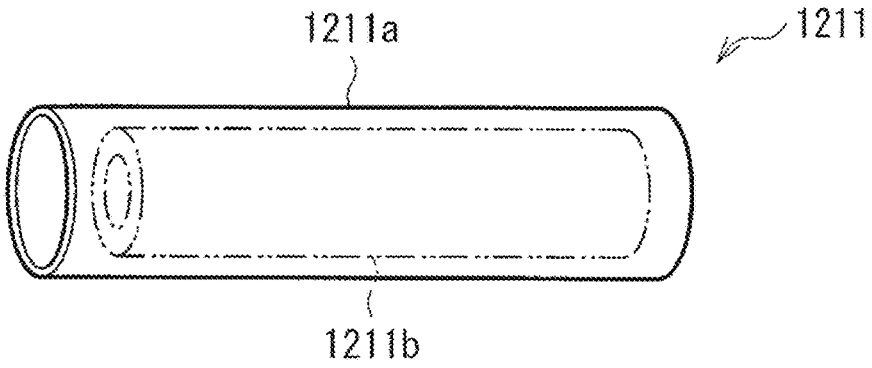
Figure 3B:
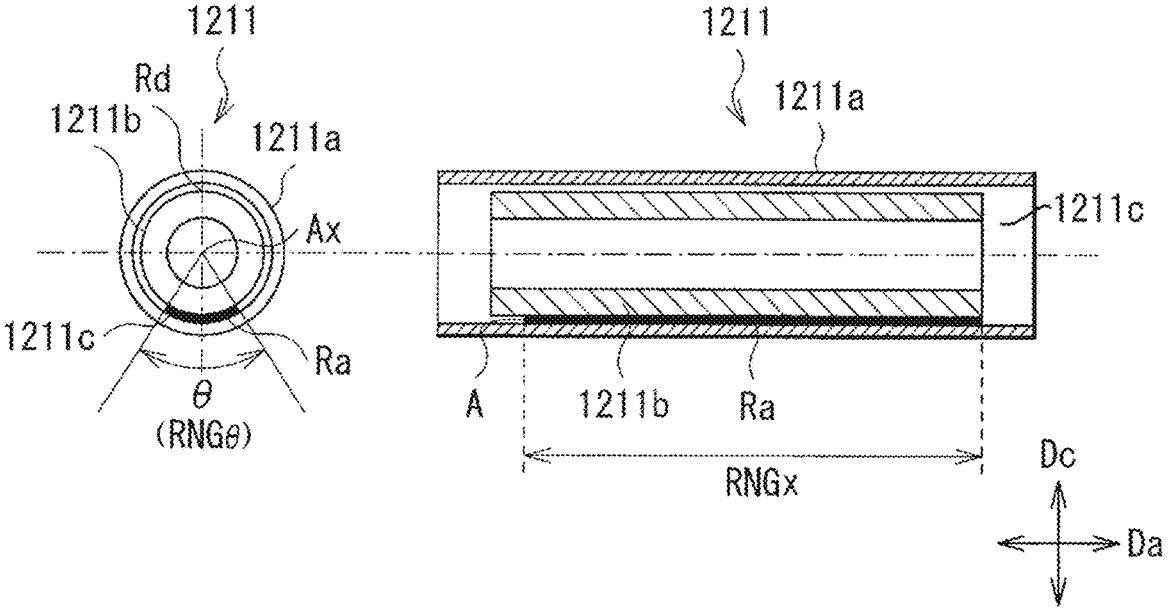

FIG. 3A is a diagram illustrating a perspective view of a configuration of the photosensitive drum 1211; and FIG. 3B is a diagram illustrating cross-sectional views of the photosensitive drum 1211 taken along the longitudinal direction and the transverse direction thereof.

The photosensitive drum member 1211*a* is an example of an "image carrier member." In a first embodiment, the photosensitive drum member 1211*a* is composed of a pipe member made of an aluminum alloy as a bare tube and a photoconductive layer formed on the outer circumferential surface of the pipe member. The silencer 1211*b* is an example of an "insert member." In a first embodiment, the silencer 1211*b* is made of a resin such as PET (polyethylene terephthalate) resin, ABS resin, or the like. The silencer 1211*b* is inserted in the photosensitive drum member 1211*a* with being approximately coaxial with the photosensitive drum member 1211*a*, and is bonded and fixed to the photosensitive drum member 1211*a* by the adhesive. Here, a concept that the silencer 1211*b* is "approximately coaxial" with the photosensitive drum member 1211*a* includes a state in which the center axes of the two are completely coincident (i.e., completely coaxial) and also a state in which the center axes of the two are close to completely coaxial. For example, if misalignment of the center axes of the two is less than or equal to a value within the range of 50 μm to 500 μm (e.g., 100 μm), it is considered "approximately coaxial."

The coefficient of thermal expansion of the aluminum alloy constituting the bare tube is 2.3E-05/K, that of PET resin is 6.5E-05/K, and that of ABS resin is 5.87E-05/K. Therefore, in a first embodiment, the thermal expansion coefficient of the silencer 1211*b* is greater than that of the bare tube of the photosensitive drum member 1211*a*, that is, the silencer 1211*b* exhibits greater deformation than the photosensitive drum member 1211*a* in response to changes in temperature. However, the material of the silencer 1211*b* is not limited to resin, but may also be a material other than resin, such as brass, stainless steel, or the like. Furthermore, other examples of the resin applicable to the silencer 1211*b* include polycarbonate, polyacetal, acrylic, polyphenylene ether, urethane, and nylon (registered trademark).

The length and weight of the photosensitive drum member 1211*a* and the silencer 1211*b* inserted therein can be selected as appropriate according to the length required for printing operation as the photosensitive drum, the frequency of vibration to be suppressed, the contact conditions with other components such as the charging roller 1212, the development roller 1213, and the cleaning blade 1217 that contact the photosensitive drum 1211, and the like.

The adhesive used for bonding the photosensitive drum member 1211*a* and the silencer 1211*b* is a cyanoacrylate-based or epoxy-based adhesive having a curing property. In a first embodiment, a cyanoacrylate-based adhesive is employed as the adhesive. The cyanoacrylate adhesive is an adhesive having a 2-cyanoacrylate monomer as a main component. Applicable examples thereof include Aron Alpha (registered trademark) manufactured by Toa Gosei Co., Ltd and Loctite (registered trademark) manufactured by Henkel Japan Co., Ltd. The epoxy-based adhesive is a two-component curable adhesive, curing of which starts when a curing agent is mixed with a main agent. Applicable examples thereof include High Super 5, EP001 N manufactured by Cemedine Corporation, TB1500 series adhesives manufactured by ThreeBond Co., and the like. The amount of the adhesive to be applied can be selected based on relationships with the type of the adhesive, the range (angle) to which the adhesive is attached, and the like. The range to which the adhesive is attached is explained in detail later.

Here, in a case where a silicon-based adhesive is applied to bond the silencer to the photosensitive drum, the silencer rotates with a slight delay to the rotation of the photosensitive drum member because the silicon-based adhesive itself has elastic properties. This may cause the photosensitive drum to vibrate, resulting in abnormal noise. In view of this, in a first embodiment, a cyanoacrylate or epoxy adhesive is employed as an adhesive having a curing property.

For bonding the silencer to the photosensitive drum member (or the bare tube of the photosensitive drum), there is a method of continuously applying the adhesive to the inner circumferential surface of the photosensitive drum member over the entire circumferential direction thereof, and then pushing the silencer in the axial direction into the photosensitive drum member on which the adhesive is applied. According to this method, an unevenness may occur in an attached range of the adhesive after insertion of the silencer in the axial direction and in the circumferential direction. Therefore, during actual use (that is, during printing operation of the printing apparatus), a difference may occur in the amount of deformation between the photosensitive drum member and the silencer due to the difference in their thermal expansion rates, and this difference in the amount of deformation may cause distortion or unevenness on the surface of the photosensitive drum member (that is, the surface of the photosensitive drum), resulting in a loss of uniformity in the nip with the charging roller or the development roller. This problem may tend to be more pronounced when the silencer is thick-walled while the photosensitive drum member (especially the bare tube) is thin-walled. The loss of the nip uniformity may result in defects such as uneven density in a printed image. A first embodiment addresses these issues.

Here, cyanoacrylate or epoxy adhesives have higher hardness but lower elasticity characteristics compared to silicon-based adhesives. In a case where a silicon-based adhesive is applied, when a difference occurs in the amount of deformation between the photosensitive drum member and the silencer, negative affect caused by this difference to the photosensitive drum can be absorbed and mitigated by the elasticity of the silicon-based adhesive itself. On the other hand, cyanoacrylate or epoxy adhesives, due to their properties, do not have the same effects as the silicon-based adhesive in mitigating the above negative affect. Therefore, in a first embodiment, the range to which the adhesive is attached to bond the photosensitive drum member and the silencer is specified.

(Detailed Configuration of Bonding Area)

Returning to FIG. 3B, the photosensitive drum member 1211*a* and the silencer 1211*b* are bonded by the adhesive A applied on the inner circumferential surface 1211*c* (a bondable area) of the photosensitive drum member 1211*a*. It may be suitable to make the outer diameter of the silencer 1121*b* smaller than the inner diameter of the photosensitive drum member 1211*a* (i.e., the inner diameter of the bare tube of the photosensitive drum 1211) by 50 μm to 500 μm, in order to interpose the adhesive A therebetween in a preferable state. On the inner circumferential surface 1211*c* of the photosensitive drum member 1211*a*, there are: an area Ra (bonding area Ra) to which the adhesive A is attached (that is, an area Ra in the inner circumferential surface 1211*c* of the photosensitive drum member 1211*a* that is bonded to the silencer 1211*b*); and an area Rd to which the adhesive A is not attached (hereinafter may be referred to as a "nonbonding area"). In a first embodiment, over the entire range RNGx of the bonding area Ra in the axial direction Da of the silencer 1211*b*, the non-bonding area Rd is provided. That is, over the entire range RNGx of the bonding area Ra in the axial direction Da, the bonding area Ra is discontinuous in the circumferential direction Dc. To put it another way, within the entire range RNGx of the bonding area Ra in the axial direction, the cross-section of the photosensitive drum 1211 taken along a plane orthogonal to the center axis of the silencer 1211*b* always includes both the bonding area Ra and the non-bonding area Rd in the circumferential direction. The bonding area Ra and the non-bonding area Rd are described further below with reference to FIG. 5.

In this disclosure, in order to determine preferred modes of the bonding area Ra, a range (bonding range RNG) in which the bonding area Ra exists is defined. The bonding range RNG is a range where one or more bonding areas Ra are fitted for each of one or more silencers 1211*b* on the inner circumferential surface 1211*c* of the photosensitive drum member 1211*a* (or on the outer circumferential surface of the silencer 1211*b*), and is represented by a rectangle defined by a length RNGx (a first length or an axial length) thereof in the direction of the center axis of the silencer 1211*b* or the photosensitive drum member 1211*a* and an angle θ or a length RNGθ(a second length or a circumferential length) thereof in the circumferential direction about the center axis. For example, in an example illustrated in FIG. 5, the bonding range RNG is a rectangle area in which the bonding area Ra is fitted, indicated by an imaginary line in FIG. 5 on the inner circumferential surface 1211*c* of the photosensitive drum member 1211*a*. In another example illustrated in FIGS. 8A and 8B, the bonding range RNG is a rectangle area in which the bonding area Ra is fitted, indicated by an imaginary line in FIG. 8B which illustrates the state where the photosensitive drum member 1211*a* is unfolded in a flat plane.

In a first embodiment, as illustrated in FIG. 3B, an angle θ of the bonding range RNG in the circumferential direction Dc about the center axis Ax of the silencer 1211*b* is within 35 to 110 degrees, and is more preferably within 50 to 110 degrees.

Figure 6A:
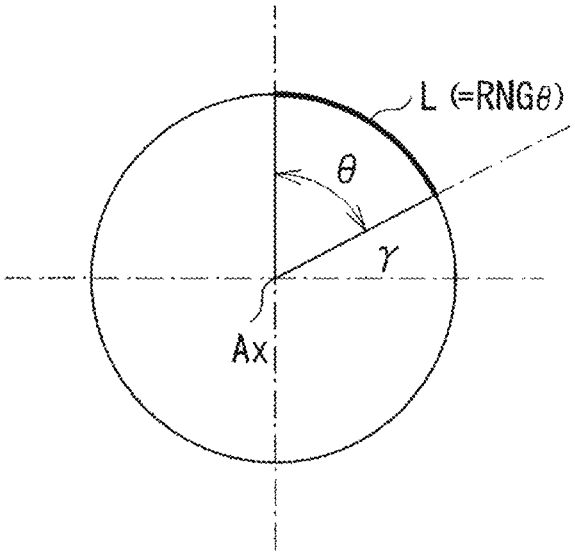
Figure 6B:
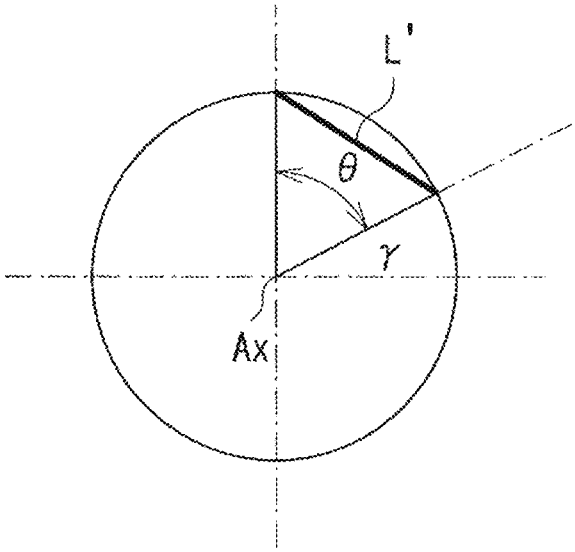

FIGS. 6A and 6B are diagrams illustrating views for explaining methods for defining the angle θ, in the circumferential direction about the axis, of the area Ra (the bonding area Ra) to which the adhesive A is adhered. FIG. 6A illustrates a method of measuring the length L (=RNGθ) of the arc over which the bonding area Ra extends in the circumferential direction and calculating the angle θ based on a ratio of the arc length L with respect to a length (=2πr) of the entire circumference whose radius is r. In contrast, FIG. 6B illustrates a method of specifying a string (length L') connecting both ends of the bonding area Ra, and calculating the angle θ based on a sine function (sin (θ/2) =2r/L') with respect to a half (=θ/2) of the angle of the arc over which the bonding area Ra extends in the circumferential direction. Note that "r" is the radius of the arc.

Figure 4A:
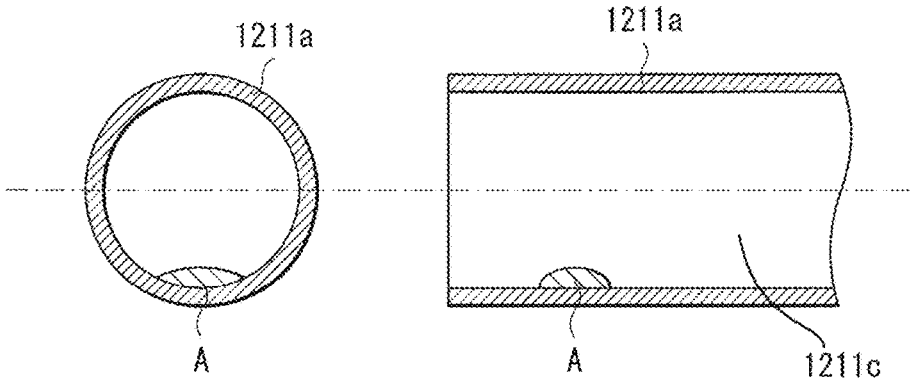
FIGS. 4A and 4B are explanatory diagrams illustrating a bonding process between an image carrier member and a silencer in the image carrier.
Figure 4B:
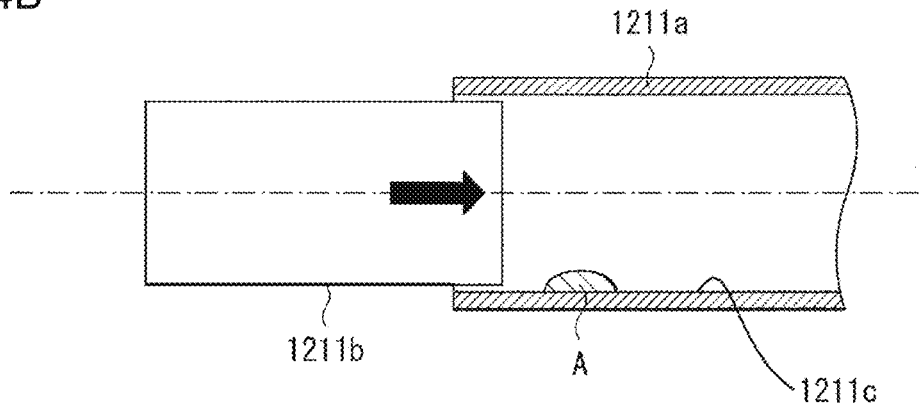

FIGS. 4A and 4B are explanatory diagrams schematically illustrating a bonding process to bond the silencer 1211*b* to the photosensitive drum member 1211*a* of the photosensitive drum 1211.

In a first embodiment, the adhesive A is placed on a portion of the inner circumferential surface of the photosensitive drum member 1211*a* that is in the vicinity of an opening end of the photosensitive drum member 1211*a* on the upstream side of the insertion direction of the silencer 1211*b* as illustrated in FIG. 4A. Then, as illustrated in FIG. 4B, the silencer 1211*b* is inserted into the photosensitive drum member 1211*a* through the opening end portion where the adhesive A is placed. After the silencer 1211*b* is inserted up to a predetermined position in the photosensitive drum member 1211*a*, it is left for a predetermined period of time to cure the adhesive A to bond the silencer 1211*b* to the photosensitive drum member 1211*a*.

Figure 5:
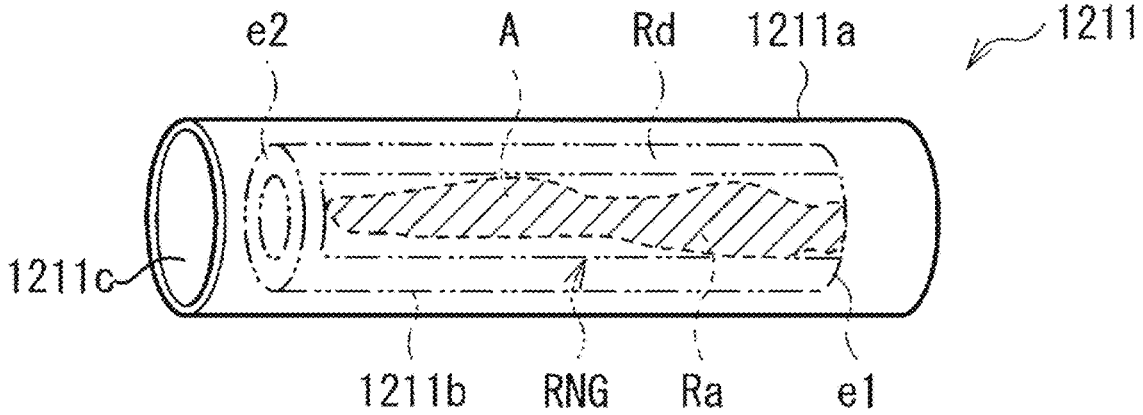
FIG. 5 is a schematic diagram illustrating a view of a configuration of the image carrier illustrating a bonding area and a range where the bonding area exits.

FIG. 5 is a schematic diagram illustrating the area in which the adhesive is attached (the bonding area Ra) formed by the bonding process illustrated in FIGS. 4A and 4B. FIG. 5 illustrates the bonding area Ra indicated by the shaded area surrounded by dotted lines. FIG. 5 also illustrates the bonding range RNG surrounded by an imaginary line, which is the rectangular area where the bonding area Ra extends (where the bonding area Ra is fitted). After bonding by the adhesive A, the silencer 1211*b* is separated from the photosensitive drum member 1211*a* by applying an impact or the like, not by a release agent, and the photosensitive drum member 1211*a* is unfolded into a plane by opening it from a cut line extending in the axial direction Da, so that an outline shape (contour shape) of the bonding area Ra can be visually ascertained (see FIG. 8B and FIG. 9C).

In a first embodiment, in a state where the silencer 1211*b* is bonded to the photosensitive drum member 1211*a*, the adhesive A, that is, the bonding area Ra, is discontinuous in the circumferential direction Dc of the silencer 1211*b*. In other words, the bonding area Ra extends less than 360 degrees in the circumferential direction Dc. The bonding area Ra has the length RNGx in the axial direction Da longer than the length RNG in the circumferential direction Dc (see FIG. 3B). That is, the rectangle range RNG in which the bonding area Ra is fitted has the length RNGx in the axial direction Da longer than the length RNGθ in the circumferential direction Dc (see FIG. 3B).

The bonding area Ra extends in the axial direction Da from one end e1 of the silencer 1211*b* in the axial direction Da to a portion in the vicinity of the other end e2 of the silencer 1211*b* in the axial direction Da, wherein the other end e2 of the silencer 1211*b* is provided in the vicinity of an opening end of the photosensitive drum member 1211*a* through which the silencer 1211*b* is inserted, and the one end e1 of the silencer 1211*b* is provided away from the opening of the photosensitive drum member 1211*a* through which the silencer 1211*b* is inserted.

(Operations and Effects)

The printing apparatus 1 and the photosensitive drum 1211 included in the printing apparatus 1 according to a first embodiment are configured as described above, and effects thereof are described below.

First, the bonding area Ra to which adhesive A is attached and the non-bonding area Rd to which adhesive A is not attached are provided on the inner circumferential surface 1211*c* of the photosensitive drum member 1211*a*, such that the photosensitive drum member 1211*a* and the silencer 1211*b* are bonded to each other by the adhesive A that is discontinuously provided along the circumferential direction Dc of the silencer 1211*b* (by the adhesive A that extends less than 360 degrees in the circumferential direction Dc). This makes it possible to suppress the deformation (e.g. unevenness) of the surface of the photosensitive drum member 1211*a* (that is, the surface of the photosensitive drum 1211), for example, when the silencer 1211*b* is deformed more than the photosensitive drum member 1211*a* (mainly in the axial direction Da), due to the difference in the thermal expansion rate between the photosensitive drum member 1211*a* and the silencer 1211*b*, which may affect to and deform the surface of the photosensitive drum 1211. Therefore, it is possible to suppress defects such as uneven density in the printed image so as to obtain a better image. This contributes to further improvement in the image quality.

Second, the bonding area Ra is provided in such a manner that the length RNGx thereof in the axial direction Da of the silencer 1211*b* is longer than the length RNGθ thereof in the circumferential direction Dc. Accordingly, it is easy to secure an area of the bonding region Ra to bond the photosensitive drum member 1211*a* and the silencer 1211*b*.

Third, by placing the adhesive A on the portion of the inner circumferential surface 1211*c* of the photosensitive drum member 1211*a* that is in the vicinity of the opening end of the photosensitive drum member 1211*a* and then pushing the silencer 1211*b* into the photosensitive drum member 1211*a*, not only the specific method of bonding the photosensitive drum member 1211*a* and the silencer 1211*b* with the adhesive A is provided, but also easy formation of the bonding area Ra is realized.

Fourth, by setting the angle θ of the bonding area Ra in the circumferential direction to be in the range of 35 to 110 degrees, the bonding strength by the adhesive A between the photosensitive drum member 1211*a* and the silencer 1211*b* can be secured, and the deformation on the surface of the photosensitive drum member 1211*a* can be well suppressed while providing the resistance to impact or the like received when dropped. Here, by setting the angle θ to be in the range of 50 to 110 degrees in particular, it is possible to further enhance the effects of improving the resistance to impact and the like and suppressing deformation on the surface of the photosensitive drum member 1211*a*.

Fifth, by employing the cyanoacrylate-based or epoxy-based adhesive as the adhesive A, a high hardness can be obtained by the adhesive A after drying, so that when the photosensitive drum 1211 is rotated (e.g., during printing operation), the followability of the silencer 1211*b* to the photosensitive drum member 1211*a* is enhanced. Accordingly, it is possible to suppress the generation of abnormal noise from the photosensitive drum 1211 in a good manner.

OTHER EMBODIMENTS

In a first embodiment described above, only one silencer 1211*b* is inserted in the photosensitive drum member 1211*a*. However, the disclosure is not limited thereto and the number of silencers 1211*b* inserted in the photosensitive drum member 1211*a* is not limited to one, and may be two or more. In a second embodiment, a plurality (specifically, two) of silencers 1211*b* are inserted in a photosensitive drum member 1121*a*, that is longer in the axial direction Da than that of a first embodiment described above.

Figure 7A:
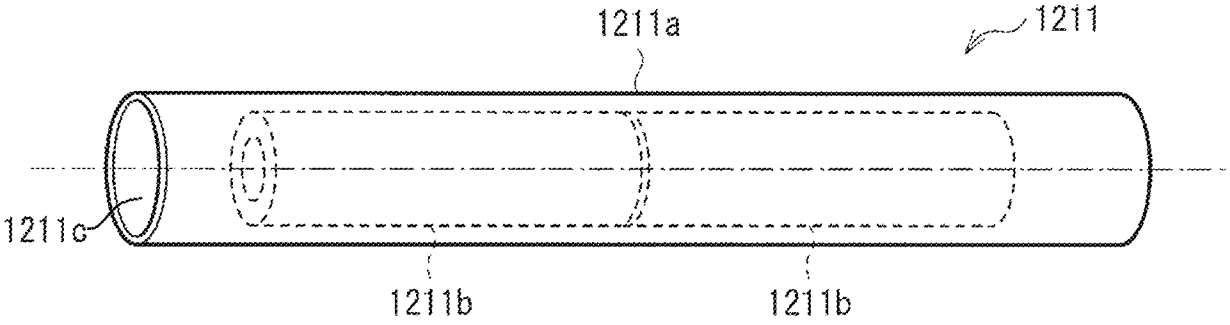
Figure 7B:
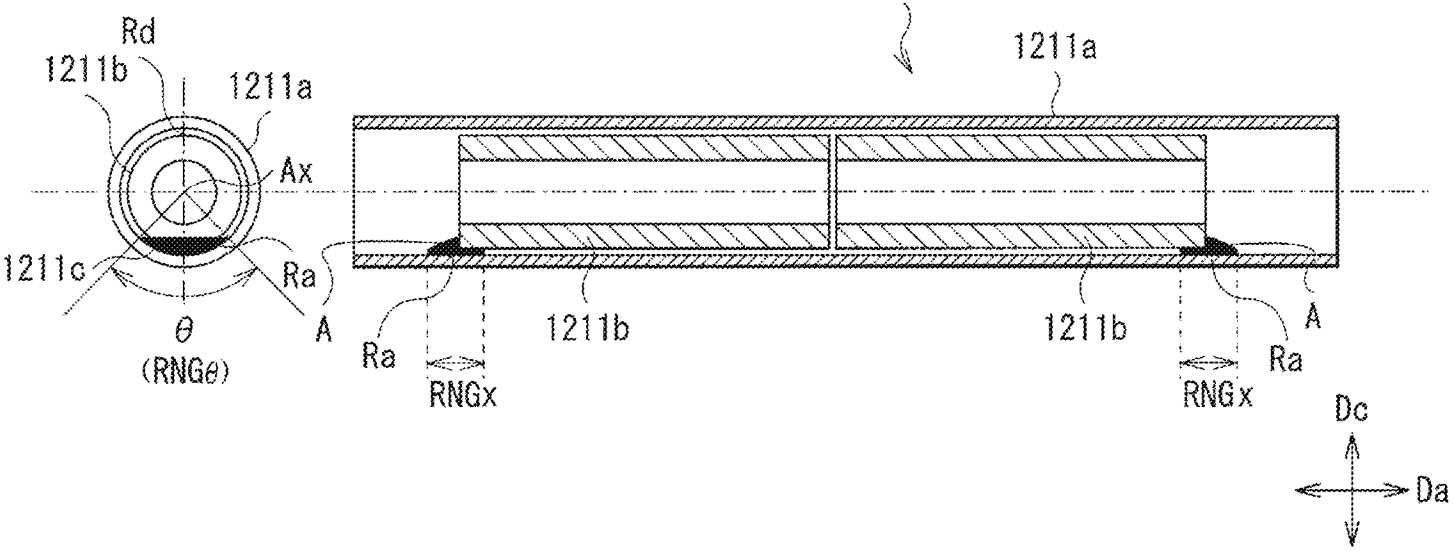

FIGS. 7A and 7B are diagrams illustrating a configuration of a photosensitive drum 1211 according to a second embodiment, wherein FIG. 7A illustrates a schematic view of the photosensitive drum 1211 and FIG. 7B illustrates cross-sectional views of the photosensitive drum 1211 taken along a longitudinal direction and a transverse direction thereof. In the description of a second embodiment, the elements corresponding to the photosensitive drum 1211 (FIG. 3) and each part thereof of a first embodiment described above are marked with the same signs as in a first embodiment described above, so that the repeated description may be omitted.

The photosensitive drum 1211 according to a second embodiment includes two silencers 1211*b* including a first silencer 1211*b* that is disposed on one side (the left side in FIG. 7A) of the axial direction Da in the photosensitive drum member 1211*a* and is shorter than the photosensitive drum member 1211*a* in the axial direction Da and a second silencer 1211*b* (the right side in FIG. 7A) that is disposed on the other side of the axial direction Da of the photosensitive drum member 1211*a* and is shorter than the photosensitive drum member 1211*a* in the axial direction Da. In a second embodiment, the two silencers 1211*b* are identical in length to each other. However, in this disclosure, a relationship between their lengths is not limited thereto, and one may be longer than the other.

Furthermore, in a second embodiment, a gap is provided between the first silencer 1211*b* and the second silencer 1211*b* in the state where they are bonded to the photosensitive drum member 1211*a*. That is, the first and second silencers 1211*b* are in a separated relationship from each other. The gap is preferably wide enough to allow and absorb the deformation of both the first and second silencers 1211*b* in the axial direction Da when they are deformed by thermal expansion.

Figures 8A, 8B:
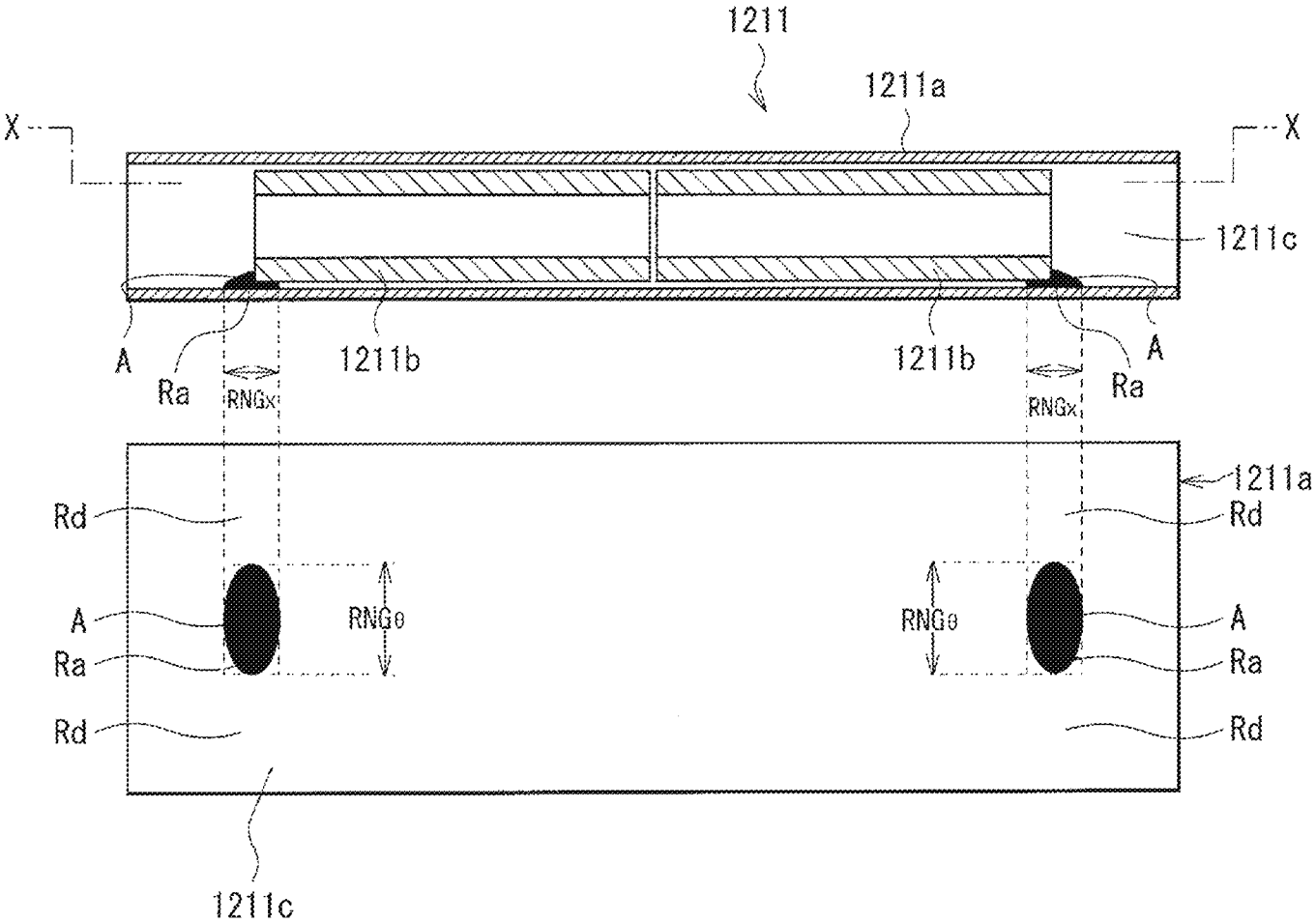

Further, in addition to FIG. 7B, as also illustrated in FIGS. 8A and 8B, on the inner circumferential surface 1211*c* of the photosensitive drum member 1211*a*, the area (bonding area Ra) to which the adhesive A is adhered is provided at only one of both end portions in the axial direction Da of each silencer 1211*b*. Each of the bonding areas Ra extends in such a manner that the length RNGθ of the bonding area Ra in the circumferential direction Dc is longer than the length RNGx of the bonding area Ra in the axial direction Da. Specifically, the bonding area Ra is provided at only one of both end portions in the axial direction Da of each silencer 1211*b* that faces and is closer to the corresponding opening end of the photosensitive drum member 1211*a*. At each bonding area Ra, the adhesive A is provided between the inner circumferential surface of the photosensitive drum member 1211*a* and the outer circumferential surface of the silencer 1211*b*, and also is attached to an end surface of the silencer 1211*b* that faces and is close to the opening of the photosensitive drum member 1211*a*. That is, in the photosensitive drum 1211 illustrated in FIGS. 7A to 8B, the adhesive A provided to the first silencer 1211*b* on the left side is attached to the left end portion of the outer circumferential surface of the silencer 1211*b* opposed to the inner circumferential surface of the photosensitive drum member 1211*a* and is attached to the left end surface of the silencer 1211*b* facing the left opening of the photosensitive drum member 1211*a*. The adhesive A provided to the second silencer 1211*b* on the right side is attached to the right end portion of the outer circumferential surface of the second silencer 1211*b* opposed to the inner circumferential surface of the photosensitive drum member 1211*a* and is attached to the right end surface of the silencer 1211*b* facing the right opening of the photosensitive drum member 1211*a*.

The angle θ of the bonding area Ra in which the adhesive A is attached in the circumferential direction Dc about the center axis Ax is in the range from 90 to 210 degrees, more preferably the range from 110 to 170 degrees.

In this way, unlike a first embodiment, in the photosensitive drum 1211 according to a second embodiment illustrated in FIGS. 7A to 8B, each of the bonding areas Ra extends in such a manner that the length RNGθ of the bonding area Ra in the circumferential direction Dc is longer than the length RNGx of the bonding area Ra in the axial direction Da. This configuration expands the range of options for forming the bonding area Ra.

Further, by limiting the bonding area Ra to the area near the end portion of the silencer 1211*b*, it is possible to downsize the bonding area Ra and reduce the amount of the adhesive A used, while achieving both of the effects of securing the resistance to impact or the like and suppressing deformation on the surface of the photosensitive drum 1211. According to a second embodiment, the adhesive A is also attached on the end surface of the silencer 1211*b* facing the opening of the photosensitive drum member 1211*a*, so that the silencer 1211*b* can be well suppressed from coming off.

A suitable range for achieving both effects is provided, by setting the angle θ of the bonding area Ra in the circumferential direction within the range from 90 to 210 degrees, in particular from 110 to 170 degrees.

FIGS. 8A and 8B are schematic diagrams illustrating the bonding area Ra formed by the bonding process in the photosensitive drum 1211 according to a second embodiment. FIG. 8A illustrates a state after assembly in which the silencers 1211*b* are inserted in the photosensitive drum member 1211*a*. FIG. 8B illustrates a state in which the silencer 1211*b* are removed from the photosensitive drum member 1211*a* and the photosensitive drum member 1211*a* is unfolded into a flat plane by opening it along the X-X line extending in the axial direction indicated by the double-dotted chain line in FIG. 8A. The photosensitive drum 1211 illustrated in FIG. 8A is hereinafter referred to as an "example".

Figures 9A, 9B, 9C:
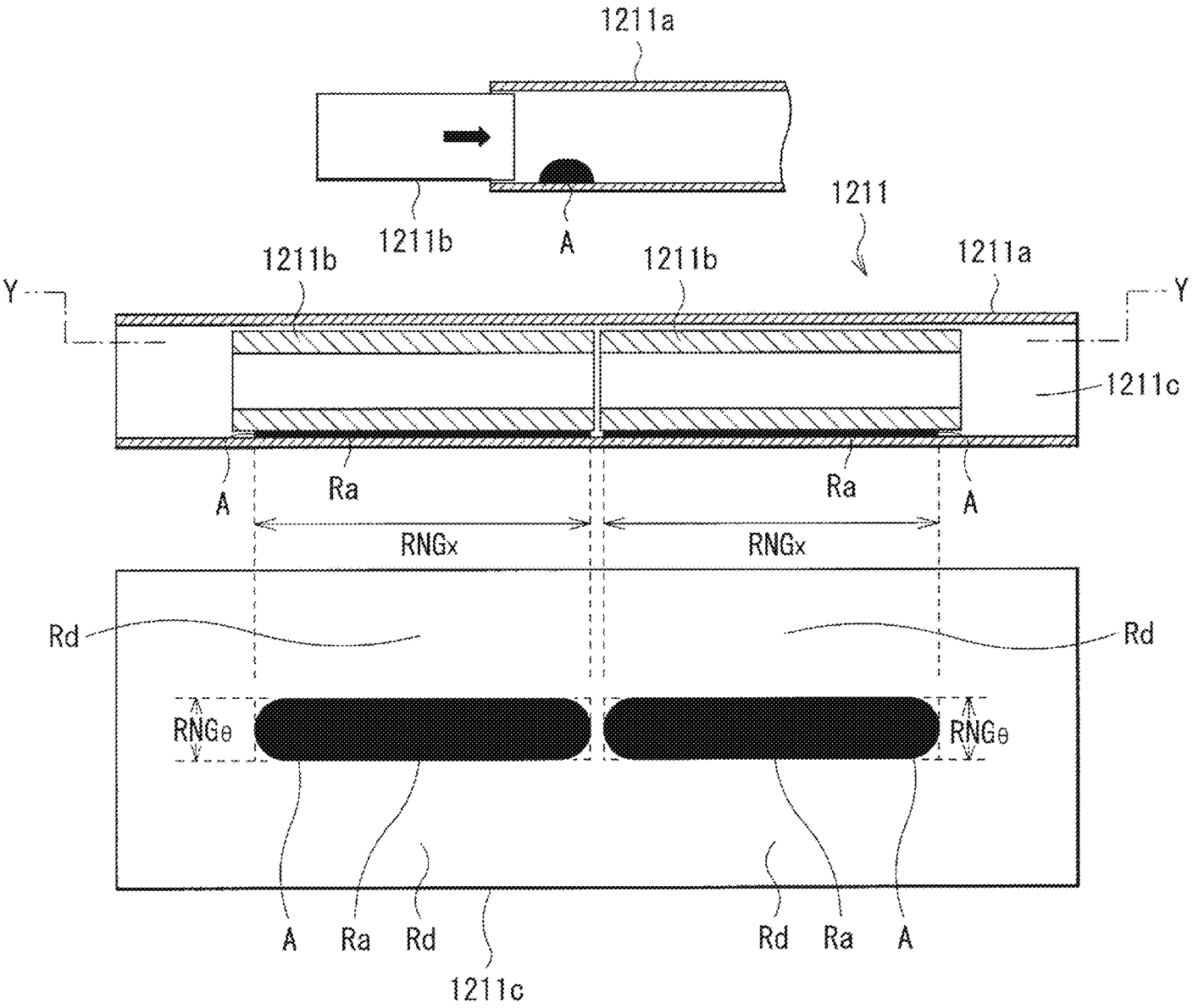

FIGS. 9A to 9C are schematic diagrams for explaining a bonding area Ra formed by a bonding process in a photosensitive drum 1211 according to a variation example of a second embodiment (hereinafter referred to as a "variation example"). FIG. 9A illustrates a relationship between a photosensitive drum member 1211*a*, silencers 1211*b*, and an adhesive A before insertion of the silencers 1211*b*. FIG. 9B illustrates a state after assembly, that is, the photosensitive drum 1211 in which the two silencers 1211*b* are inserted in the photosensitive drum member 1211*a*. FIG. 9C illustrates a state where the silencers 1211*b* are removed from the photosensitive drum member 1211*a* and the photosensitive drum member 1211*a* is unfolded into a plane by opening it along the Y-Y line extending in the axial direction indicated by the double-dotted chain line in FIG. 9B.

Figure 10A:
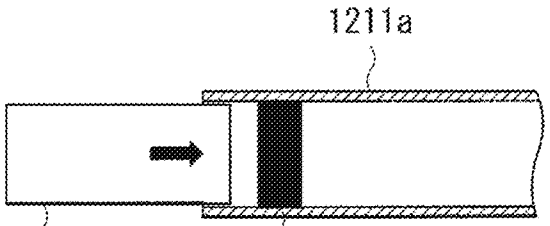
FIGS. 10A to 10C are schematic diagrams for explaining a bonding area formed by a bonding process for an image carrier according to a comparative example.
Figure 10B:
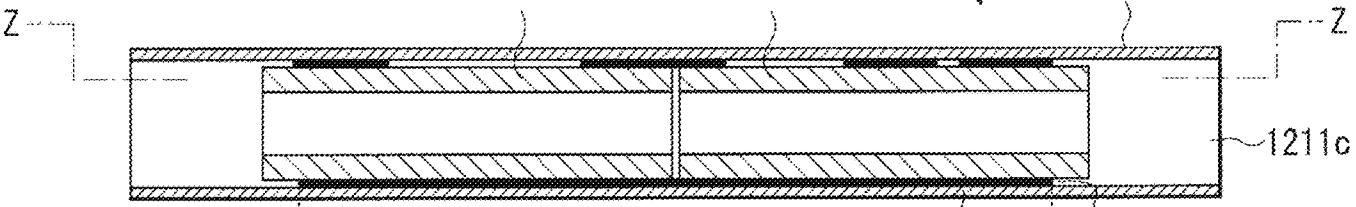
Figure 10C:
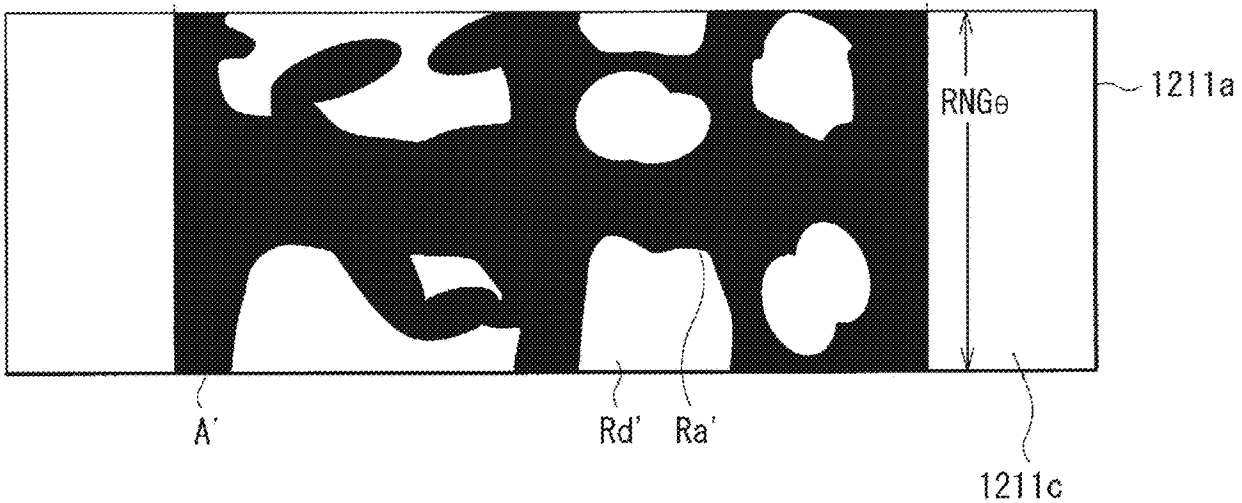

FIGS. 10A to 10C are schematic diagrams for explaining a bonding area Ra' and a non-bonding area Rd' formed by a bonding process in a photosensitive drum 1211' according to a comparative example (hereinafter may be simply referred to as a "comparative example"). Note that FIG. 10A illustrates a relationship of an image carrier member 1211*a*, silencers 1211*b*, and an adhesive A' before insertion of the silencers 1211*b*, FIG. 10B illustrates a state after assembly in which the two silencers 1211*b* are accommodated in the image carrier member 1211*a*, and FIG. 10C is a development view of the image carrier member 1211*a* illustrating a state where the image carrier member 1211*a* is unfolded into a plane from a cutting line Z extending along the axial direction thereof.

For the purpose of further promoting understanding of the effects, evaluation tests conducted on the example illustrated in FIGS. 8A to 8B, the variation example illustrated in FIGS. 9A to 9C, and the comparative example illustrated in FIGS. 10A to 10C and the results thereof are described below.

The photosensitive drums used in the evaluation tests are as follows.

Example

As the bare tube, a cylindrical pipe made of JIS 6000 series aluminum alloy with an inner diameter of 22.51 mm, a length of 246 mm and a thickness of 0.71 mm is employed. As the silencers, a cylindrical insertion member made of PET resin with an outer diameter of 22.25 mm, a length of 100 mm and a thickness of 5.0 mm is employed. The photoconductive layer is formed by layering an underlay layer, the charge generation layer, and the charge transport layer on the outer surface of the bare tube by the immersion coating method. The silencers are inserted from both opening ends of the photosensitive drum member, respectively, and after the insertion, the adhesive is dripped onto the end portions of the silencers near the openings of the photosensitive drum member and cured, so that the photosensitive drum 1211 having the configuration illustrated in FIG. 8A is manufactured. As the adhesive, a cyanoacrylate-based adhesive (e.g., Aron Alpha 432TW, manufactured by Toagosei) is employed.

Variation Example

As the bare tube, a cylindrical pipe made of JIS 6000 series aluminum alloy with an inner diameter of 22.51 mm, a length of 246 mm and a thickness of 0.71 mm is employed. As the silencers, a cylindrical insertion member made of PET resin with an outer diameter of 22.25 mm, a length of 100 mm and a thickness of 5.0 mm is employed. The photoconductive layer is formed by layering an underlay layer, the charge generation layer, and the charge transport layer on the outer surface of the bare tube by the immersion coating method. One drip of the adhesive is applied onto each of positions 20 mm inward from the opening ends of the photosensitive drum member, and then the silencers are inserted into the photosensitive drum member through the opening ends of the photosensitive drum member, respectively. The silencers are left in a state in which the ends of the silencers near the opening ends of the photosensitive drum member are at the positions 20 mm inward from the opening ends of the photosensitive drum member, to cure the adhesive, so that the photosensitive drum 1211 having the configuration illustrated in FIG. 9B is manufactured. As the adhesive, a cyanoacrylate adhesive (e.g., Aron Alpha 432TW) is employed.

Comparative Example

As the bare tube, a cylindrical pipe made of JIS 6000 series aluminum alloy with an inner diameter of 22.51 mm, a length of 246 mm and a thickness of 0.71 mm is employed. As the silencers, a cylindrical insertion member made of PET resin with an outer diameter of 22.25 mm, a length of 100 mm and a thickness of 5.0 mm is employed. The photoconductive layer is formed by layering an underlay layer, the charge generation layer, and the charge transport layer on the outer surface of the bare tube by the immersion coating method. The adhesive is applied at a position 20 mm inward from each opening end of the photosensitive drum member in such manner that the adhesive extends continuously over 360 degrees in the circumferential direction of the photosensitive drum member. Then the silencers are inserted in the photosensitive drum member through the opening ends of the photosensitive drum member, respectively. The silencers are left in a state in which the ends of the silencers near the opening ends of the photosensitive drum member are at the positions 20 mm inward from the opening ends of the photosensitive drum member so as to cure the adhesive, so that the photosensitive drum 1211' having the configuration illustrated in FIG. 10B is manufactured. As the adhesive, a cyanoacrylate adhesive (e.g., Aron Alpha 432TW) is employed as in the example.

The evaluation tests are conducted as follows.

(Evaluation by Heat Cycle Test)

The photosensitive drum to be evaluated is heated to 50° C. using a thermostatic bath, maintained at the temperature for 6 hours after the heating, and then cooled over a period of 3 hours to −10° C. The temperature after cooling is then maintained for 6 hours and then the photosensitive drum is heated again over a period of 3 hours to 50° C. The above cycle is repeated two times, and then the photosensitive drum is further stored in an environment with a temperature of 10° C. and a humidity of 20% for at least 6 hours. The photosensitive drum is removed from the storage at 10° C. and 20% humidity, is placed in a normal environment (temperature 23° C., humidity 50%), and, after 5 to 10 minutes, is evaluated based on the cylindricity thereof whether there is a change in shape or not, or the change in shape is large or small. The cylindricity is calculated, for example, as the height of unevenness on the surface of the photosensitive drum, that is, the distance from the bottom of the deepest valley to the top of the highest mountain in the unevenness. As the distance increases, the cylindricity is evaluated as worsening. As the cylindricity deteriorates, the uniformity in the nip between the photosensitive drum and the charging roller is impaired, making it difficult to uniformly charge the photosensitive drum, resulting in uneven images. The loss of the nip uniformity can be a problem not only with the charging roller but also with the development roller.

(Image Evaluation)

Using the photosensitive drum after the heat cycle test, a halftone (2×2) image (hereinafter referred to as a "halftone image") is printed under a low temperature and low humidity environment of 10° C. and 20% RH, and then the presence or absence of unevenness in the printed image is evaluated.

Figure 11:
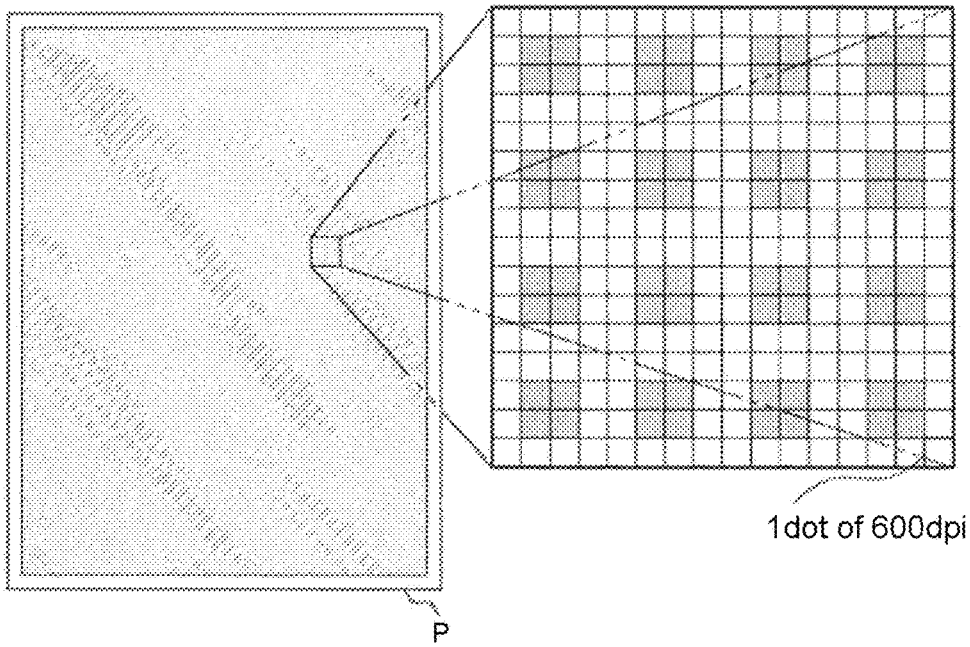
FIG. 11 is a diagram illustrating a halftone image used to evaluate image quality.

FIG. 11 is an explanatory diagram illustrating a view of the halftone image used to evaluate image quality. As illustrated in FIG. 11, the halftone image on the recording paper P is an image obtained by fixing toner on with two dots in each four dots in the main scanning direction and the sub-scanning direction among all the dots with the resolution of 600 dpi, for example.

(Noise and Jitter Image Evaluation)

When printing are performed after the heat cycle test with the photosensitive drum at the rotation speeds of 200 rpm and 50 rpm, the presence or absence of noise generated by the photosensitive drum and the presence or absence of a jitter image (horizontal threads in a printed image) are evaluated. Furthermore, it is evaluated whether or not the blade squeals when the rotation is stopped.

(Impact Resistance Evaluation)

The photosensitive drum after the heat cycle test is dropped three times from a height of 50 cm and evaluated if there is any peeling of the adhesive or coming off of the silencer from the photosensitive drum after the drops. The height is set based on the impact when dropped. Here, the height is set so that the impact of acceleration of 80 G to 100 G is applied when dropped.

Figure 12:
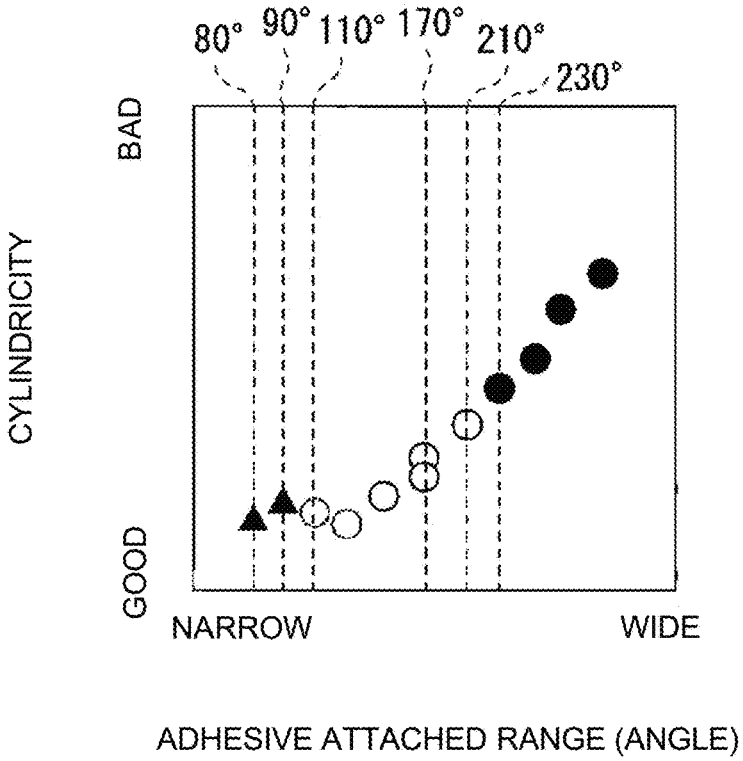
FIG. 12 is an explanatory diagram illustrating an example of evaluation results of suppression of deformation with respect to the range (angle) of the adhesive being attached.

FIG. 12 is an explanatory diagram illustrating evaluation results on the photosensitive drum 1211 of the example (FIG. 8), performed with varying the range (angle θ) of the adhesive A attached to the photosensitive drum 1211.

When the angle θ of the bonding area Ra in the circumferential direction is 90 degrees or less, good results are obtained in all of the evaluations of the heat cycle test, the image evaluation, and the abnormal noise/jitter image evaluation; however, the silencer 1211*b* is found to be come off in some or all of the three drops in the impact resistance evaluation. In FIG. 12, the black triangle represent a case where the silencer 1211*b* is observed to be come off in any one of three drops. Specifically, when the angle θ of the bonding area Ra is 80 degrees or less, the silencer 1211*b* is observed to be come off in the first of three drops. When the angle θ of the bonding area Ra is 90 degrees, the silencer 1211*b* is not observed to be come off in the first and second drops, but is observed to be come off in the third drop. Therefore, when the angle θ of the bonding area Ra is 90 degrees, it can be said that a reasonable impact resistance can be obtained, although it is not excellent. In contrast, when the angle θ of the bonding area Ra is 110 degrees or more, the silencer 1211*b* is not observed to be come off in all three drops, and good results are obtained in the impact resistance evaluation. On the other hand, when the angle θ of the bonding area Ra is 230 degrees or more, good results are obtained in the image evaluation and the abnormal noise/jitter image evaluation; however, deteriorations of cylindricity are observed in the evaluation in the heat cycle test, and uneven images are observed in the halftone image in the image evaluation. In FIG. 12, the black circle represents a case in which unevenness is observed in the halftone image. In contrast, when the angle θ of the bonding area Ra is 210 degrees or less, good results are obtained in all the evaluations. In FIG. 12, the white circle represents a case where a good evaluation is obtained.

From the evaluation results illustrated in FIG. 12, it is preferable that the angle θ of the bonding area Ra in the photosensitive drum 1211 according to the example (FIG. 8A) is 90 degrees or more and 210 degrees or less, and it is more preferable that the angle θ is 110 degrees or more and 210 degrees or less. Here, if the angle θ of the bonding area Ra is wide, it is possible to apply the adhesive A in a narrower area than the actual bonding area Ra, and then rotate the silencer 1211*b* in one direction before the adhesive A cures, thereby widening the area of adhesion of the adhesive A so as to achieve the bonding area Ra having the desired angle θ. In a case of forming the bonding area Ra by simply dropping (applying) the adhesive A without using the above described method involving such rotation, it is more suitable that the angle θ is 170 degrees or less.

Figure 13:
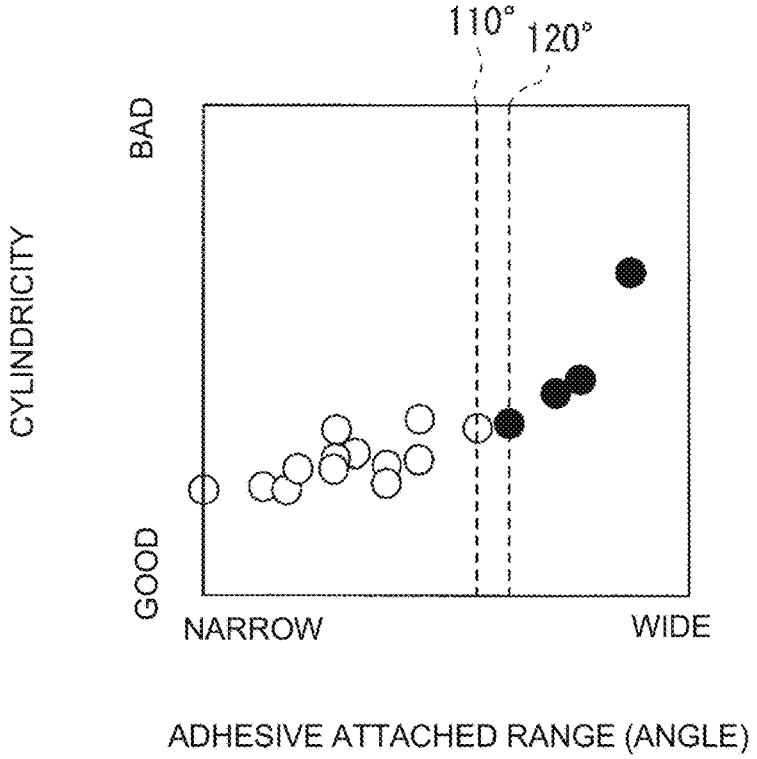
FIG. 13 is an explanatory diagram illustrating another example of evaluation results of suppression of deformation with respect to the range (angle) of the adhesive being attached.
Figure 14:
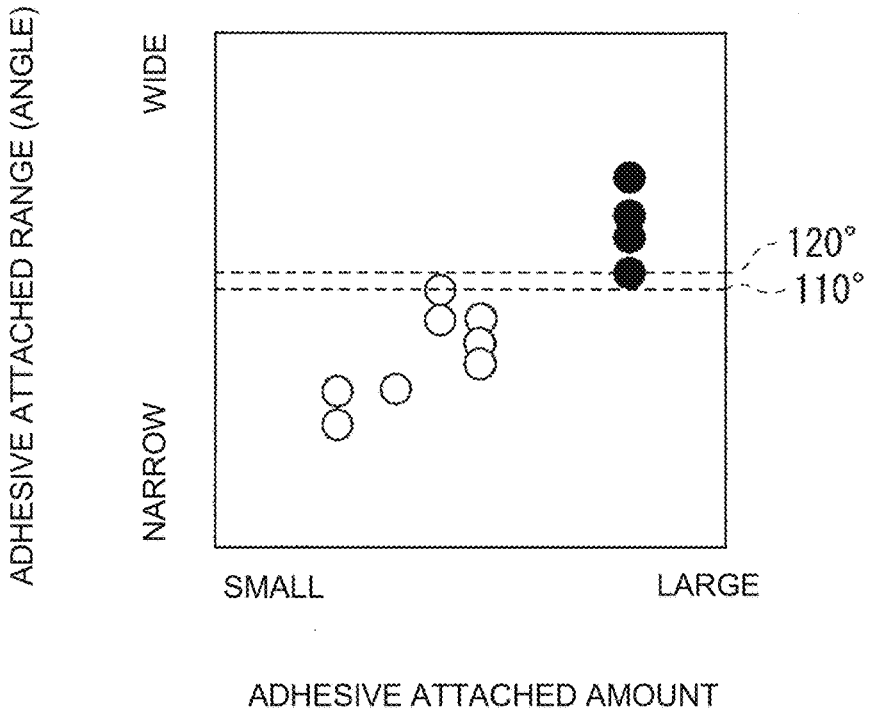
FIG. 14 is an explanatory diagram illustrating an example of evaluation results of image quality with respect to the amount and the range (angle) of the adhesive being attached.

FIGS. 13 and 14 are explanatory diagrams illustrating evaluation results of heat cycle tests and image evaluations on the photosensitive drum 1211 of the variation example (FIG. 9B), performed with varying the amount and the range (angle θ) of the adhesive A attached to the photosensitive drum 1211.

From the evaluation results of the heat cycle test illustrated in FIG. 13, it is difficult to clearly distinguish between good and bad depending on the angle θ of the bonding region Ra in the circumferential direction. However, according to the results of the image evaluation illustrated in FIG. 14, although unevenness is observed in the halftone image when the angle θ of the bonding area Ra exceeds 110 degrees (specifically, 120 degrees or more), good results are obtained when the angle θ of the bonding area Ra is 110 degrees or less. In FIG. 13, the black circle represents a case where deterioration in cylindricity is observed, that is, where unevenness of a certain size or larger occurs on the surface of the photosensitive drum 1211, whereas the white circle represents a case where no deterioration in cylindricity is observed. In FIG. 14, the black circle represents a case where unevenness is recognized in the halftone image, whereas the white circle represents a case where unevenness is not recognized in the halftone image.

Figure 15:
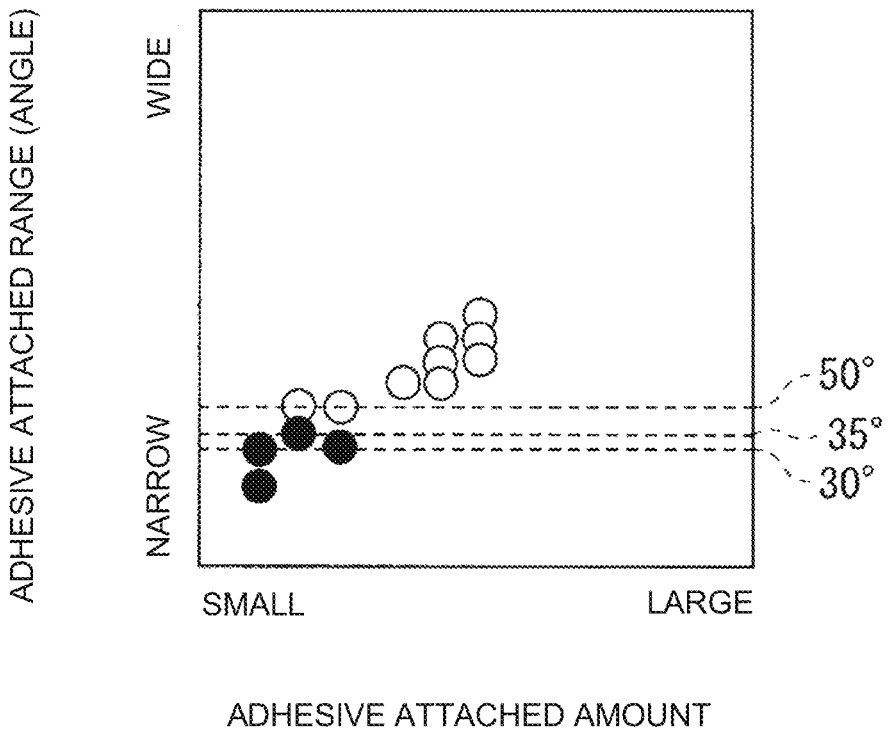
FIG. 15 is an explanatory diagram illustrating an example of evaluation results of impact resistance tests with respect to the amount and the range (angle) of the adhesive being attached.

FIG. 15 is an explanatory diagram illustrating impact resistance evaluation results on the photosensitive drum 1211 of the variation example (FIG. 9B), performed with varying the amount and the range (angle θ) of the adhesive A attached to the photosensitive drum 1211.

When the angle θ of the bonding area Ra is less than 35 degrees, the silencer 1211*b* is observed to be come off in all of the drop tests performed, but when the angle θ of the bonding area Ra is 35 degrees or more, an improvement is observed, that is, a decrease in the number of times the coming off of the silencer 1211*b* occurred is observed. Specifically, when the angle θ is 30 degrees or less, the silencer 1211*b* is observed to be come off in the first of the three drops performed, and when the angle θ is 35 degrees, the silencer 1211*b* is not observed to be come off in the first and second drops, but the silencer 1211*b* is observed to be come off in the third drop. Therefore, it can be said that if the angle θ is less than 30 degrees, sufficient impact resistance cannot be obtained, and if the angle θ is 35 degrees or more, and preferably 45 degrees or more, reasonable impact resistance can be expected, although not excellent. Furthermore, when the angle θ is 50 degrees or more, no drop of the silencer 1211*b* is observed in all three drops, and good results are obtained. In FIG. 15, the black circle represents a case where the silencer 1211*b* is found to be come off at least once in three drops, and the white circle represents a case where no drop of the silencer 1211*b* is found in the three drops.

From the results illustrated in FIGS. 13-15, in the photosensitive drum 1211 of the variation example (FIG. 9), it is preferable that the angle θ of the bonding area Ra is within the range from 35 to 110 degrees, and it is more preferable that the angle θ of the bonding area Ra is within the range from 50 to 110 degrees.

In the results of the evaluations (FIGS. 12-15) for the example (FIG. 8A) and the variation example (FIG. 9B), no significant differences are found depending on the material of the silencer 1211*b*, i.e., whether it is made of ABS resin or PET resin.

In the above description, on the inner circumferential surface 1211*c* of the photosensitive drum member 1211*a*, the bonding area Ra is formed continuously within the angle θ in the circumferential direction Dc of the silencer 1211*b*. However, the formation of the bonding area Ra is not limited thereto, and it is also possible to form the bonding area Ra discontinuously within the angle θ, that is, to form the bonding area Ra into plural portions (plural bonding areas Ra) separated from each other in the circumferential direction Dc within the angle θ. As examples of such a case, FIGS. 16A and 16B illustrate configurations of photosensitive drums 1211 according to a third embodiment.

Figure 16A:
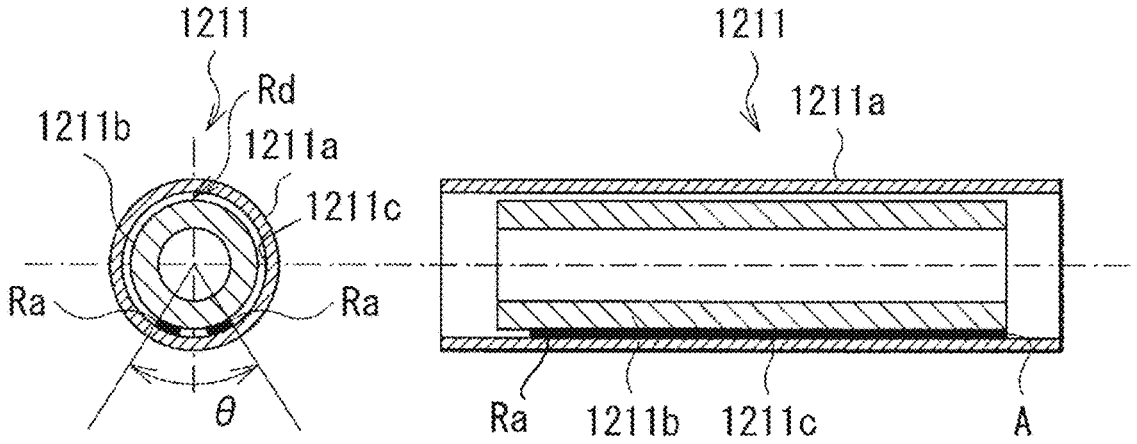
FIG. 16A is a diagram illustrating cross-sectional views taken along a longitudinal direction and a transverse direction of an image carrier according to another embodiment.

FIG. 16A is a diagram illustrating an example of a photosensitive drum 1211 applicable to the method of forming the bonding area Ra such as being illustrated in FIG. 3B. In the example illustrated in FIG. 16A, the bonding area Ra extends from one end portion to the other end portion in the axial direction Da of the silencer 1211*b*, that is, the bonding area Ra extends in the axial direction Da from a portion in the vicinity of the one end portion of the photosensitive drum member 1211*a* to a portion in the vicinity of the other end portion of the photosensitive drum member 1211*a*. In the photosensitive drum 1211 illustrated in FIG. 16A, the bonding area Ra includes plural portions (plural bonding areas Ra) separated from each other in the circumferential direction Dc. The angle θ of the range RNG in which the bonding area Ra is fit, that is, the angle θ of the range RNG in which the plural separated bonding area Ra (the plural separated bonding areas Ra) are fit, is the same as in the variation example illustrated in FIGS. 9A to 9C, and thus is in the range of 35 to 110 degrees, more preferably in the range of 50 to 110 degrees.

Figure 16B:
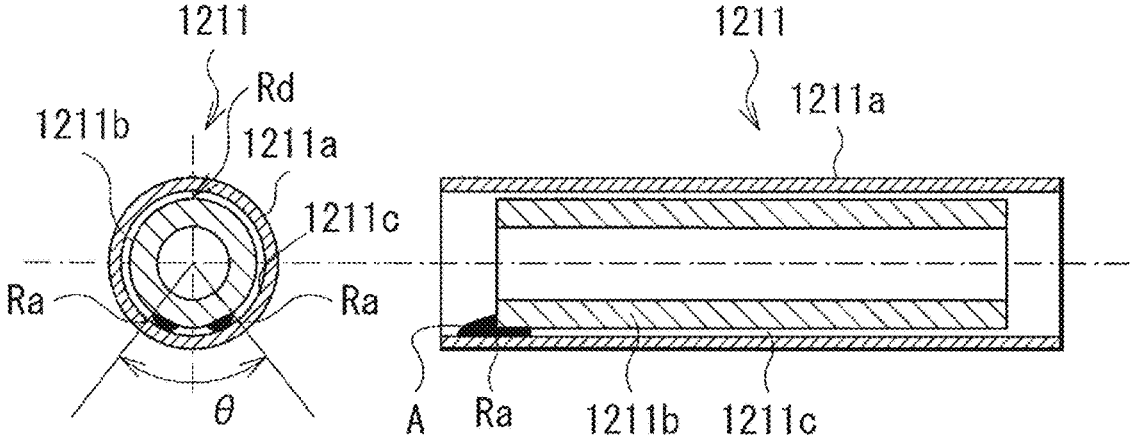
FIG. 16B is a diagram illustrating cross-sectional views taken along a longitudinal direction and a transverse direction of an image carrier according to still another embodiment.

FIG. 16B is a diagram illustrating an example of a photosensitive drum 1211 applicable to the method of forming the bonding area Ra such as being illustrated in FIG. 7B. In the example illustrated in FIG. 16B, the bonding area Ra is provided at only one end portion of the silencer 1211*b* in the axial direction Da that is close to an opening of the photosensitive drum member 1211*a*. The adhesive A is not only provided between the inner circumferential surface of the photosensitive drum member 1211*a* and the outer circumferential surface of the silencer 1211*b*, but also is adhered to the end surface of the silencer 1211*b* in the axial direction (facing the opening of the photosensitive drum member 1211*a*). In this photosensitive drum 1211 illustrated in FIG. 16B, the bonding area Ra includes plural portions (plural bonding areas Ra) separated from each other in the circumferential direction Dc. The angle θ of the range RNG in which the bonding area Ra having the plural separated portions (plural bonding areas Ra) in the circumferential direction is fitted, is the same as in the example illustrated in FIGS. 8A and 8B, and is in the range of 90 to 210 degrees, more preferably in the range of 110 to 170 degrees.

Thus, by forming the bonding area Ra having the plural portions separated from each other in the circumferential direction Dc instead of the bonding area Ra continuously extending in the circumferential direction Dc, the degree of freedom of design in forming the bonding area Ra is expanded. Also, by forming the bonding area Ra having the plural portions separated from each other in the circumferential direction Dc, each separated portion of the bonding area Ra uses a small amount of the adhesive A, and this makes it easy to control the amount of the adhesive A used for the entire photosensitive drum 1211 or the entire photosensitive drum member 1211*a*.

Figure 17:
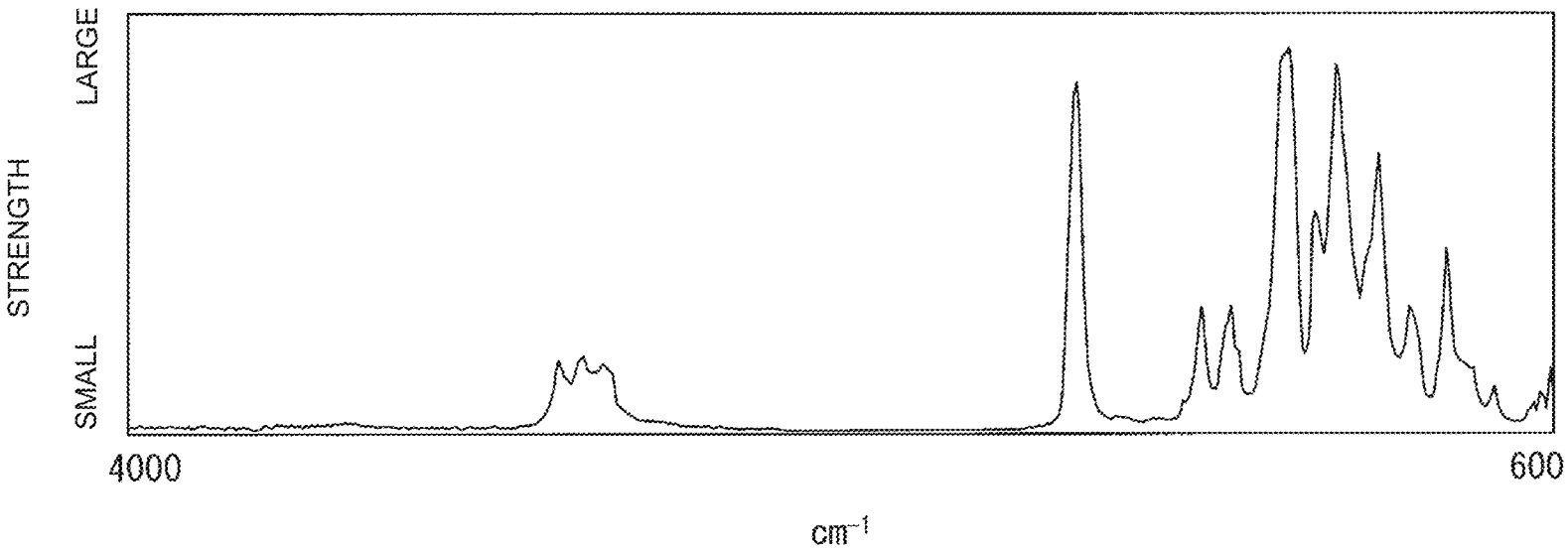
FIG. 17 is an explanatory diagram illustrating an example of an infrared absorption spectrum of an adhesive obtained by FTIR (Fourier Transform Infrared Spectroscopy) analysis.
Figures 18A, 18B, 18C, 18D:
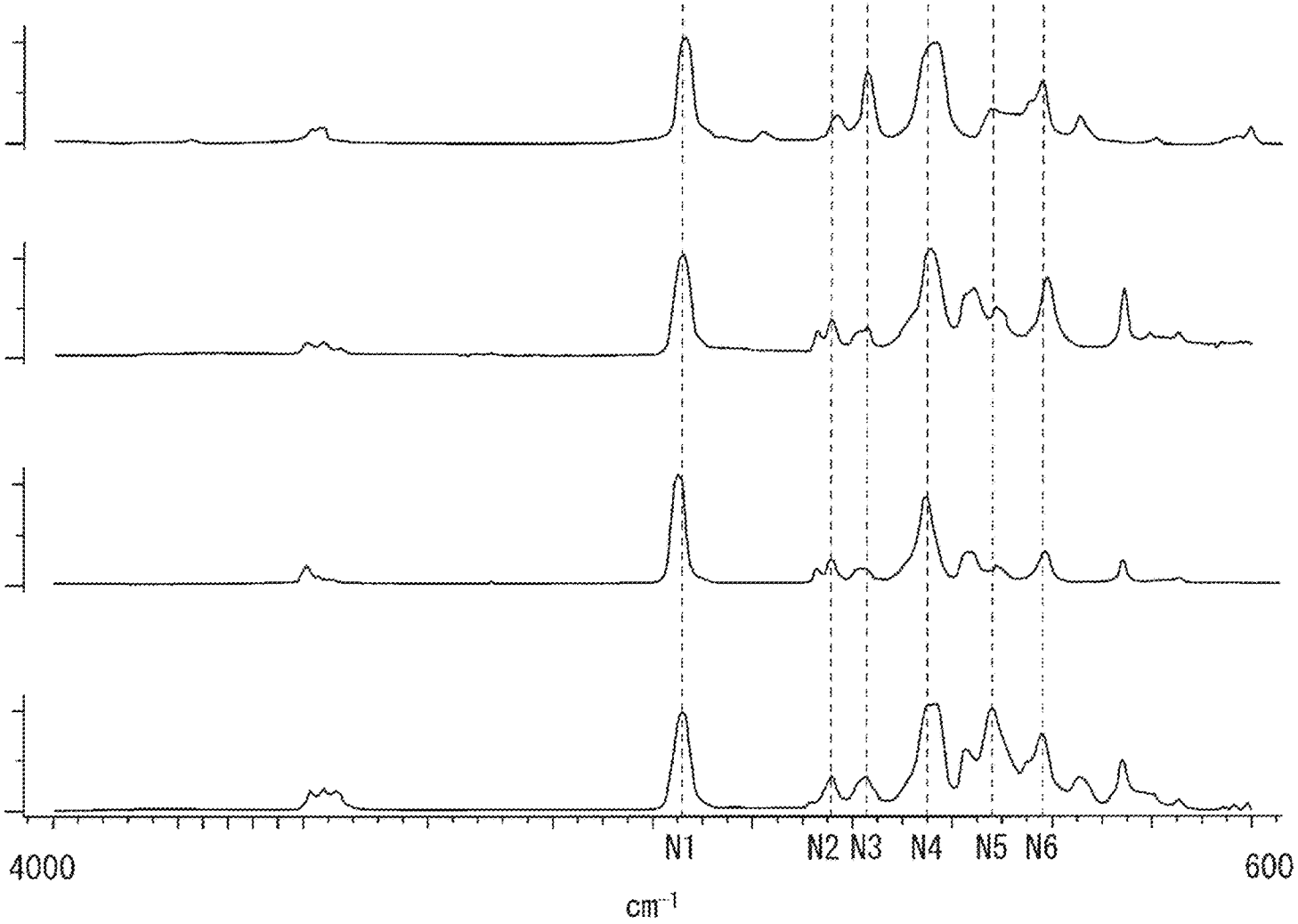
FIGS. 18A to 18D are explanatory diagrams illustrating infrared absorption spectrums of plural cyanoacrylate-based adhesives obtained by FTIR analysis.

The adhesive A after being cured can be identified by Fourier transform infrared spectroscopy (FTIR). FIG. 17 is an explanatory diagram illustrating an example of an infrared absorption spectrum of a cyanoacrylate adhesive obtained by FTIR.

FIGS. 18A to 18D are explanatory diagrams illustrating infrared absorption spectrums of a plurality types of cyanoacrylate adhesives obtained by FTIR. It can be seen that even different adhesives have similar infrared absorption spectra to each other because they are in the same cyanoacrylate system. Thus, the identification of the adhesive is possible by extracting and comparing the wavenumber N (e.g., N1 to N6) and the value of each peak in the infrared absorption spectrum. Specifically, if the following wavenumbers N1 to N6 appear in the infrared absorption spectrum of the adhesive to be inspected, it is possible to determine that the adhesive is a cyanoacrylate adhesive.

N1 peak around 1741 $cm^{-1}$ indicating the spectrum of C═O stretching

N2 peak around 1443 $cm^{-1}$ indicating the spectrum of C—H bending

N3 peak around 1372 $cm^{-1}$ indicating the spectrum of C—H bending

N4 peak around 1240 $cm^{-1}$ indicating the spectrum of C—O stretching

N5 peak around 1118 $cm^{-1}$ indicating the spectrum of C—O stretching

N6 peak around 1019 $cm^{-1}$ indicating the spectrum of C—C stretching

The invention includes other embodiments or modifications in addition to one or more embodiments and modifications described above without departing from the spirit of the invention. The one or more embodiments and modifications described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image carrier comprising:

a cylindrical image carrier member including an outer circumferential surface formed with an image carrier layer configured to carry a developer image;

one or more silencers disposed in the image carrier member; and a bonding member that bonds the one or more silencers to an inner circumferential surface of the image carrier member, wherein for each silencer, the inner circumferential surface of the image carrier member includes one or more bonding areas to which the bonding member is attached, and a bonding range, in which the one or more bonding areas are fit, for each silencer, has a length thereof in an axial direction of the silencer being greater than a length thereof in a circumferential direction of the silencer, wherein an angle of the bonding range in the circumferential direction about an axis of the silencer is within 35 to 110 degrees.

2. The image carrier according to claim 1, wherein the angle of the bonding range in the circumferential direction about the axis of the silencer is within 50 to 110 degrees.

3. The image carrier according to claim 1, wherein the one or more silencers comprises:

a first silencer shorter than the image carrier member in the axial direction and disposed on one side in the image carrier member in the axial direction; and a second silencer shorter than the image carrier member in the axial direction and disposed on the other side in the image carrier member in the axial direction.

4. The image carrier according to claim 1, wherein the one or more bonding areas for each silencer comprises only one bonding area in the axial direction, such that each silencer is bonded by the only one bonding area to the inner circumferential surface of the image carrier member.

5. An image carrier unit comprising:

the image carrier according to claim 1; and an image carrier container in which the image carrier is provided.

6. An image formation apparatus comprising:

the image carrier unit according to claim 5.

7. An image carrier comprising:

a cylindrical image carrier member including an outer circumferential surface formed with an image carrier layer configured to carry a developer image;

one or more silencers disposed in the image carrier member; and a bonding member that bonds the one or more silencers to an inner circumferential surface of the image carrier member, wherein for each silencer, the inner circumferential surface of the image carrier member includes one or more bonding areas to which the bonding member is attached, a bonding range, in which the one or more bonding areas are fit, for each silencer, has a length thereof in an axial direction of the silencer being greater than a length thereof in a circumferential direction of the silencer, and the one or more bonding areas for each silencer comprises plural bonding areas separated from each other in the circumferential direction about an axis of the silencer.

8. An image carrier comprising:

a cylindrical image carrier member including an outer circumferential surface with an image carrier layer configured to carry a developer image;

one or more silencers disposed in the image carrier member; and a bonding member that bonds the one or more silencers to an inner circumferential surface of the image carrier member, wherein for each silencer, the inner circumferential surface of the image carrier member includes one or more bonding areas to which the bonding member is attached, and a bonding range, in which the one or more bonding areas are fit, for each silencer, is provided in such a manner that an angle of the bonding range in a circumferential direction of the silencer about an axis of the silencer is within 90 to 210 degrees.

9. The image carrier according to claim 8, wherein the angle of the bonding range in the circumferential direction about the axis of the silencer is within 110 to 170 degrees.

10. The image carrier according to claim 8, wherein the one or more silencers comprises:

a first silencer shorter than the image carrier member in an axial direction and disposed on one side in the image carrier member in the axial direction; and a second silencer shorter than the image carrier member in the axial direction and disposed on the other side in the image carrier member in the axial direction.

11. The image carrier according to claim 10, wherein the bonding range for the first silencer is provided at an end portion of the image carrier member on the one side in the axial direction, and the bonding range for the second silencer is provided at an end portion of the image carrier member on the other side in the axial direction.

12. The image carrier according to claim 8, wherein the bonding member is provided between the inner circumferential surface of the image carrier member and an outer circumferential surface of each silencer and is attached to an end face in an axial direction of the silencer.

13. The image carrier according to claim 8, wherein the bonding range is provided in such a manner that a length thereof in the circumferential direction is greater than a length thereof in an axial direction of the silencer.

14. The image carrier according to claim 8, wherein the one or more bonding areas comprises plural bonding areas separated from each other in the circumferential direction about the axis of the silencer.

15. The image carrier according to claim 8, wherein the one or more bonding areas for each silencer comprises only one bonding area in an axial direction of the silencer, such that each silencer is bonded by the only one bonding area to the inner circumferential surface of the image carrier member.

16. An image carrier unit comprising:

the image carrier according to claim 8; and an image carrier container in which the image carrier is provided.

17. An image formation apparatus comprising the image carrier unit according to claim 16.

18. An image carrier comprising:

a cylindrical image carrier member including an outer circumferential surface with an image carrier layer configured to carry a developer image;

one or more silencers disposed in the image carrier member; and a bonding member that bonds the one or more silencers to an inner circumferential surface of the image carrier member, wherein the one or more silencers comprises:

a first silencer shorter than the image carrier member in an axial direction and disposed on one side in the image carrier member in the axial direction; and a second silencer shorter than the image carrier member in the axial direction and disposed on the other side in the image carrier member in the axial direction, for each of the first silencer and the second silencer, the inner circumferential surface of the image carrier member includes one or more bonding areas to which the bonding member is attached, a bonding range, in which the one or more bonding areas are fit, for the first silencer, is provided at one of end portions of the first silencer in the axial direction, whereas a bonding range, in which the one or more bonding areas are fit, for the second silencer is provided at one of end portions of the second silencer in the axial direction, and an angle of the bonding range for the first silencer in a circumferential direction about an axis of the first silencer is within 35 to 110 degrees.

* * * * *